US010787819B2

(12) United States Patent
Diercks et al.

(10) Patent No.: US 10,787,819 B2
(45) Date of Patent: Sep. 29, 2020

(54) TEXTURED CLADDING ELEMENT WITH INTEGRATED DRIP EDGE

(71) Applicant: James Hardie Technology Limited, Dublin 2 (IE)

(72) Inventors: Chad Diercks, Yucaipa, CA (US); Alireza Mohebbi, Corona, CA (US); John Joecken, Riverside, CA (US); William J. Tinen, Trabuco Canyon, CA (US); Jared E. Kies, Perrysburg, OH (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/360,867

(22) Filed: Mar. 21, 2019

(65) Prior Publication Data

US 2019/0292792 A1 Sep. 26, 2019

Related U.S. Application Data

(60) Provisional application No. 62/646,837, filed on Mar. 22, 2018.

(51) Int. Cl.

| | |
|---|---|
| ***E04F 13/08*** | (2006.01) |
| ***E04F 13/076*** | (2006.01) |
| ***E04F 13/14*** | (2006.01) |
| ***E04F 13/16*** | (2006.01) |

(52) U.S. Cl.

CPC ..... *E04F 13/0871* (2013.01); *E04F 13/076* (2013.01); *E04F 13/0864* (2013.01); *E04F 13/141* (2013.01); *E04F 13/147* (2013.01); *E04F 13/165* (2013.01)

(58) Field of Classification Search

CPC ... E04F 13/0871; E04F 13/165; E04F 13/147; E04F 13/076; E04F 13/0864; E04F 13/141

See application file for complete search history.

(56) References Cited

U.S. PATENT DOCUMENTS 3,608,261 A 9/1971 French et al.
4,188,762 A * 2/1980 Tellman ..... E04F 13/16 52/314
4,261,152 A 4/1981 Tellman
(Continued)

FOREIGN PATENT DOCUMENTS

EP 0908578 A2 4/1999

OTHER PUBLICATIONS

Search Report in European Application No. 19164609.0 dated Aug. 9, 2019 in 4 pages.

(Continued)

*Primary Examiner* — Rodney Mintz
(74) *Attorney, Agent, or Firm* — Knobbe, Martens, Olson & Bear, LLP

(57) ABSTRACT

A textured cladding element can be manufactured to approximate the aesthetic and functional properties or natural wood siding and/or shingles. The cladding element can comprise non-wood material, such as fiber cement. The cladding element can include a step and a recessed portion or cove which enables the element to have a relatively low thickness while also achieving a desirable drip edge and/or shadow line when multiple cladding elements are overlapping when installed in a finished product.

18 Claims, 14 Drawing Sheets

(56) References Cited

U.S. PATENT DOCUMENTS

| | | | | |
|---|---|---|---|---|
| 4,366,197 | A * | 12/1982 | Hanlon | E04D 1/265 144/345 |
| 4,955,169 | A | 9/1990 | Shisko | |
| 5,362,881 | A | 11/1994 | Leistner et al. | |
| 7,155,866 | B2 | 1/2007 | Bezubic, Jr. et al. | |
| D758,618 | S * | 6/2016 | Tinen | E04D 1/265 D25/150 |
| D758,619 | S * | 6/2016 | Tinen | D25/150 |
| D848,034 | S * | 5/2019 | Heatherly | E04F 13/148 D25/150 |
| 2005/0210811 | A1 | 9/2005 | Nasvik | |
| 2007/0110981 | A1 | 5/2007 | Killilea et al. | |
| 2007/0282046 | A1 | 12/2007 | Killilea et al. | |
| 2008/0199725 | A1 | 8/2008 | Vetter et al. | |
| 2008/0236080 | A1* | 10/2008 | Heatherly | B44C 5/0461 52/385 |
| 2008/0263985 | A1 | 10/2008 | Hasch et al. | |
| 2012/0028071 | A1 | 2/2012 | Lyubomirskiy | |
| 2012/0034485 | A1 | 2/2012 | Lyubomirskiy | |
| 2012/0040204 | A1 | 2/2012 | Lyubomirskiy | |
| 2012/0047837 | A1* | 3/2012 | Schaefer | E04F 13/148 52/519 |
| 2012/0251787 | A1 | 10/2012 | Mizuno | |
| 2016/0040436 | A1 | 2/2016 | Grau | |
| 2016/0060878 | A1 | 3/2016 | Everhart, II et al. | |
| 2017/0073543 | A1 | 3/2017 | Joecken et al. | |

OTHER PUBLICATIONS

Communication Pursuant to Article 94(3) EPC in European Application No. 19164609.0 dated Mar. 9, 2020 in 5 pages.

* cited by examiner

500B

TEXTURED CLADDING ELEMENT WITH INTEGRATED DRIP EDGE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure generally relates to construction, and more specifically to textured cladding element systems and methods.

Description of the Related Art

Fiber cement articles are conventionally used as cladding materials to form the exterior and/or interior walls of a building by attaching the fiber cement article to a substrate. Fiber cement articles are an alternative to real wood and engineered wood options. It is often desirable for such fiber cement articles to have a wood grain appearance. Generally a series of peaks, valleys and flattened areas are formed in low relief on the surface of the fiber cement article so as to create a wood grain pattern on the surface. The fiber cement article is then painted or stained before or after installation on the structural building frame.

It is difficult to replicate the aesthetic appearance of natural wood. For example, natural western red cedar wood shingles show extensive variation in color hue and color depth due to the natural components of wood, such as tannins or wood lot choice. The color differences in wood are often random and include red, yellow, tan, brown and black areas, as well as variation in the degree of saturation of each color. In addition, saw cut wood shingles exhibit numerous physical and variable markings. These physical markings are often random in nature and impart significant three dimensional features to the wood.

The natural variability and aesthetics associated with cedar shingles or boards are difficult to match using manufactured fiber cement siding as the substrate. Due to the manufacturing process and equipment used to make fiber cement products, the texture pattern is sometimes considered to be overly uniform and consistent, considered to lack the three dimensional imperfections of sawn cut wood, and considered to present a monochromatic appearance when painted. Existing fiber cement shingles typically have a manufactured, flat appearance with minimal wood grain visibility or color gradation. Cedar shingles provide variability in appearance even when painted due to the inherent texture and color variation. However, copying the exact wood grain pattern from a natural cedar shingle will not necessarily result in a fiber cement shingle with the same natural wood appearance because the pattern has to be embossed when the fiber cement is in wet greensheet form, which often causes the pattern to become distorted and blurred.

In view of the foregoing, there is a need for an improved coating for fiber cement articles that creates the natural appearance of sawn cut wood.

SUMMARY

The systems, methods, and devices described herein address one or more problems as described above and associated with existing construction systems and methods. The systems, methods and devices described herein have innovative aspects, no single one of which is indispensable or solely responsible for their desirable attributes. Without limiting the scope of the claims, the summary below describes some of the advantageous features.

In one embodiment, a cladding shingle system configured to secure to an exterior of a building structure is disclosed. The cladding shingle system comprises: a first cladding shingle and a second cladding shingle. Each of the first and second cladding shingles comprise a fiber cement substrate and further comprise: a first edge and a second edge opposite the first edge; a substantially planar rear face extending between the first edge and the second edge; and a front face opposite the rear face and extending between the first edge and the second edge, the front face having a wood grain texture pattern imprinted on a portion thereof. The front face further comprises: an upper section spaced from the rear face by a first thickness, the upper section being substantially parallel to the rear face, the upper section extending from the first edge; a lower section spaced from the rear face by the first thickness, the lower section being substantially parallel to the rear face, the lower section extending from the second edge; a recessed portion having a first end adjacent the lower section and a second end opposite the first end, the first end spaced from the rear face by a first distance and the second end spaced from the rear face by a second distance, wherein the recessed portion is disposed at a first angle relative to the lower section such that the first distance is greater than the second distance, the second distance defining a minimum thickness of each of the first and second cladding shingles; and a step contiguous with the upper section and the second end of the recessed portion, the step disposed at a second angle relative to the upper section, wherein the second angle of the step is greater than the first angle of the recessed portion. The wood grain texture pattern covers at least the lower section and the recessed portion of the front face. When at least a portion of the rear face of the first cladding shingle overlaps substantially all of the upper section of the front face of the second cladding shingle, the second edge of the first cladding shingle and the step of the second cladding shingle form a drip edge having a drip edge depth, wherein the drip edge depth is greater than the first thickness.

In some embodiments, each of the wood grain texture patterns of the front faces of the first and second cladding shingles comprises a three-dimensional wood grain pattern comprising one of circular saw marks, raised fibers, edge grain, and cathedrals, and the three-dimensional wood grain pattern of the first and second cladding shingles are different from each other.

In some embodiments, the first angle of the recessed portion is between 0 degrees and 20 degrees.

In some embodiments, the second angle of the step is between 30 degrees and 90 degrees.

In some embodiments, the step comprises a shorter length than the recessed portion.

In some embodiments, the drip edge depth is greater than the first thickness by at least 5%.

In another embodiment, a cladding shingle for a building structure is disclosed, the cladding shingle configured to be installed with a plurality of additional cladding shingles on an exterior of the building structure. The cladding shingle comprises a fiber cement substrate and further comprises: a first edge and a second edge opposite the first edge; a substantially planar rear face extending between the first edge and the second edge; and a front face opposite the rear face and extending between the first edge and the second edge. The front face comprises: an upper section spaced from the rear face by a first thickness, the upper section being substantially parallel to the rear face, the upper section extending from the first edge; a lower section spaced from the rear face by a second thickness, the lower section being substantially parallel to the rear face, the lower section extending from the second edge; a recessed portion having a first end adjacent the lower section and a second end opposite the first end, the first end spaced from the rear face by a first distance and the second end spaced from the rear face by a second distance, wherein the recessed portion is disposed at a first angle relative to the lower section such that the first distance is greater than the second distance; and a step contiguous with the upper section and the second end of the recessed portion, the step disposed at a second angle relative to the upper section, wherein the second angle of the step is greater than the first angle of the recessed portion.

In some embodiments, the front face has a wood grain texture pattern, the wood grain texture pattern covering at least the lower section and the recessed portion of the front face.

In some embodiments, the wood grain texture pattern comprises circular saw marks.

In some embodiments, the step comprises a smaller portion of the front face than the recessed portion.

In some embodiments, the first thickness of the upper section is equal to the second thickness of the lower section.

In some embodiments, the first distance of the first end of the recessed portion is equal to the second thickness of the lower section.

In some embodiments, the first angle of the recessed portion is between 0 degrees and 10 degrees.

In some embodiments, the second angle of the step is between 30 degrees and 90 degrees.

In one embodiment, a method of manufacturing a cladding shingle for a building structure is disclosed. The method comprises: forming a fiber cement board comprising one or more layers of fiber cement film; forming a recessed portion and a step onto a segment of the fiber cement board, the segment having a first surface, a second surface, and a thickness between the first and second surface, wherein, when the recessed portion and the step are formed onto the segment, the recessed portion and the step are disposed in between an upper section and a lower section of the segment, the recessed portion disposed at a first angle relative to the lower section and the step disposed at a second angle relative to the upper section, the second angle being greater than the first angle; and forming a wood grain texture pattern onto at least the recessed portion and the lower section of the first surface of the segment of the fiber cement board; wherein the forming of the recessed portion and the step onto the first surface of the segment of the fiber cement board is done simultaneously with the forming of the wood grain texture pattern onto the recessed portion and the lower section of the first surface of the segment of the fiber cement board.

In some embodiments, the method further comprises separating the segment of the fiber cement board from a remainder of the fiber cement board.

In some embodiments, the segment of the fiber cement board is separated from a remainder of the fiber cement board using a cutting machine.

In some embodiments, the cutting machine is a water sprayer or water jet.

In some embodiments, the wood grain texture pattern comprises circular saw marks, the circular saw marks having a diameter of between 42" (106.68 cm) and 46" (116.84 cm).

In some embodiments, the step of forming the wood grain texture pattern onto at least the recessed portion and the lower section of the first surface of the segment of the fiber cement board comprises forming the wood grain texture pattern onto the recessed portion, the lower section, and the step of the first surface.

In another embodiment, a building article for a building structure is disclosed, the building article configured to be installed with a plurality of additional building articles. The building article comprises fiber cement and further comprises: a rear face; and a front face opposite the rear face. The front face comprises: an upper section spaced from the rear face by a first thickness; a lower section spaced from the rear face by a second thickness; a recessed portion having a first end adjacent the lower section and a second end opposite the first end, the first end spaced from the rear face by a first distance and the second end spaced from the rear face by a second distance, wherein the second distance is smaller than the first distance; and a step contiguous with the upper section and the second end of the recessed portion.

In some embodiments, the recessed portion is disposed at a first angle relative to the lower section, and wherein the step is disposed at a second angle relative to the upper section, the second angle of the step being greater than the first angle of the recessed portion.

In some embodiments, the building article is a shingle. In some embodiments, the front face has a wood grain texture pattern, the wood grain texture pattern covering at least the lower section and the recessed portion of the front face. In some embodiments, the first thickness is equal to the second thickness. In some embodiments, the first angle of the recessed portion is between 0 degrees and 30 degrees.

In one embodiment, a cladding system for building structures comprising a plurality of fiber cement cladding shingles is described. The system comprises first and second cladding shingles comprising fiber cement, each of the first and second cladding shingles mounted to a building substrate and comprising a substantially planar rear face angled from the building substrate such that an upper edge of the rear face lies adjacent to the building substrate; and a front face opposite the rear face, the front face having a wood grain texture pattern imprinted thereon. The front face comprises a substantially planar upper section parallel to the rear face and spaced from the rear face by a shingle thickness; a substantially planar lower section parallel to the rear face and spaced from the rear face by the shingle thickness; a recessed portion contiguous with the lower section, the recessed portion disposed at a first angle relative to the rear face such that an upper edge of the recessed portion proximate a lower edge of the upper section is spaced from the rear face by a distance smaller than the shingle thickness; and a step contiguous with the upper edge of the recessed portion and the lower edge of the upper section, the step disposed at a second angle greater than the first angle relative to the rear face such that the step comprises a smaller portion of the front face relative to the recessed portion, wherein the wood grain texture pattern covers at least the lower section and the recessed portion; wherein at least a portion of the rear face of the first cladding shingle overlaps substantially the entire upper section of the front face of the second cladding shingle, such that a lower edge face of the first cladding shingle and the step of the second cladding shingle form a drip edge having a drip edge depth greater than the first shingle thickness.

In some embodiments, the front face of each of the first and second cladding shingles further comprises a three-dimensional wood grain pattern imprinted on substantially all of at least the lower section and the recessed portion, and wherein the wood grain pattern of each of the first and second cladding shingles comprises a different one or combination of: circular saw marks, raised fibers, edge grain, and cathedrals.

In some embodiments, wherein the difference between the drip edge depth and the shingle thickness is at least 0.0625" (0.15875 cm).

In some embodiments, the drip edge depth is greater than the shingle thickness by at least 10% of the shingle thickness.

In some embodiments, the recessed portion of each of the first and second cladding shingles has a length of at least 1" (2.54 cm).

In another embodiment, a fiber cement cladding element for a cladding system for building structures is described, the cladding element configured to be installed with a plurality of additional cladding elements. The cladding element comprises a substantially planar rear face; and a front face opposite the rear face. The front face comprises a substantially planar upper section parallel to the rear face and spaced from the rear face by a first thickness; a substantially planar lower section parallel to the rear face and spaced from the rear face by the first thickness; a recessed portion contiguous with the lower section, the recessed portion disposed at a first angle relative to the rear face such that an upper edge of the recessed portion proximate a lower edge of the upper section is spaced from the rear face by a distance smaller than the first thickness; and a step contiguous with the upper edge of the recessed portion and the lower edge of the upper section, the step disposed at a second angle relative to the rear face such that the step and the recessed portion define a section of the cladding element having a thickness smaller than the first thickness; wherein, in an installed configuration with an additional cladding element, at least a portion of the rear face of the additional cladding element overlaps substantially the entire upper section of the front face of the cladding element, such that a lower edge member of the additional cladding element and the step of the cladding element form a drip edge having a drip edge depth greater than the first thickness.

In some embodiments, the cladding element comprises a siding shingle.

In some embodiments, the cladding element comprises a lap siding board, and wherein the lower section of the front face comprises a larger surface area relative to the upper section of the front face.

In some embodiments, at least a portion of the front face comprises a three-dimensional wood grain texture pattern imprinted thereon.

In some embodiments, the wood grain texture pattern comprises one or more of: circular saw marks, raised fibers, edge grain, and cathedrals.

In some embodiments, the wood grain texture pattern has a texture depth between 0.045" and 0.085" (1.143 mm to 2.159 mm).

In some embodiments, the three-dimensional wood grain texture pattern is imprinted on substantially all of the lower section and the recessed portion.

In some embodiments, the three-dimensional wood grain texture pattern is imprinted on substantially all of the lower section, the recessed portion, and the upper section.

In some embodiments, the cladding element is coated with at least one basecoat and at least one topcoat, the at least one basecoat and at least one topcoat selected to produce a finished color consistent with at least one of: eastern grey cedar and western red cedar.

In some embodiments, the first thickness is at least 0.25" (0.635 cm) and not greater than 0.625" (1.5875 cm), and wherein the drip edge depth is greater than the first thickness by at least 0.0625" (0.15875 cm).

In another embodiment, a set of fiber cement cladding shingles for installation to a common building substrate is described. The set comprises a plurality of fiber cement shingles each having substantially the same maximum thickness, each shingle having a front face and a rear face, the front face comprising an upper section, a lower section, and a locally thin section between the upper section and the lower section, the locally thin section comprising a step and a recessed portion configured to produce a drip edge having a depth greater than a maximum thickness of the shingle when an additional one of the shingles is installed overlapping the upper section; wherein the front faces of at least two of the shingles comprise different wood grain texture patterns selected from the group consisting of: circular saw marks, raised fibers, edge grain, and cathedrals; and wherein the front faces of at least two of the shingles have different CIELAB total color values E and at least two of the shingles have the same E value, the E values of any two of the shingles differing by a difference dE.

In some embodiments, the maximum dE between any two of the shingles is between 5 and 7.

In some embodiments, the maximum dE between any two of the shingles is approximately 6.

In some embodiments, the minimum dE between any two of the shingles having different E values is between 1.5 and 2.5.

In some embodiments, the minimum dE between any two of the shingles having different E values is approximately 2.

In some embodiments, the front faces of at least two of the shingles have different E values and comprise the same wood grain texture pattern.

In some embodiments, the front faces of at least two of the shingles have the same E value and comprise different wood grain texture patterns.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1A:
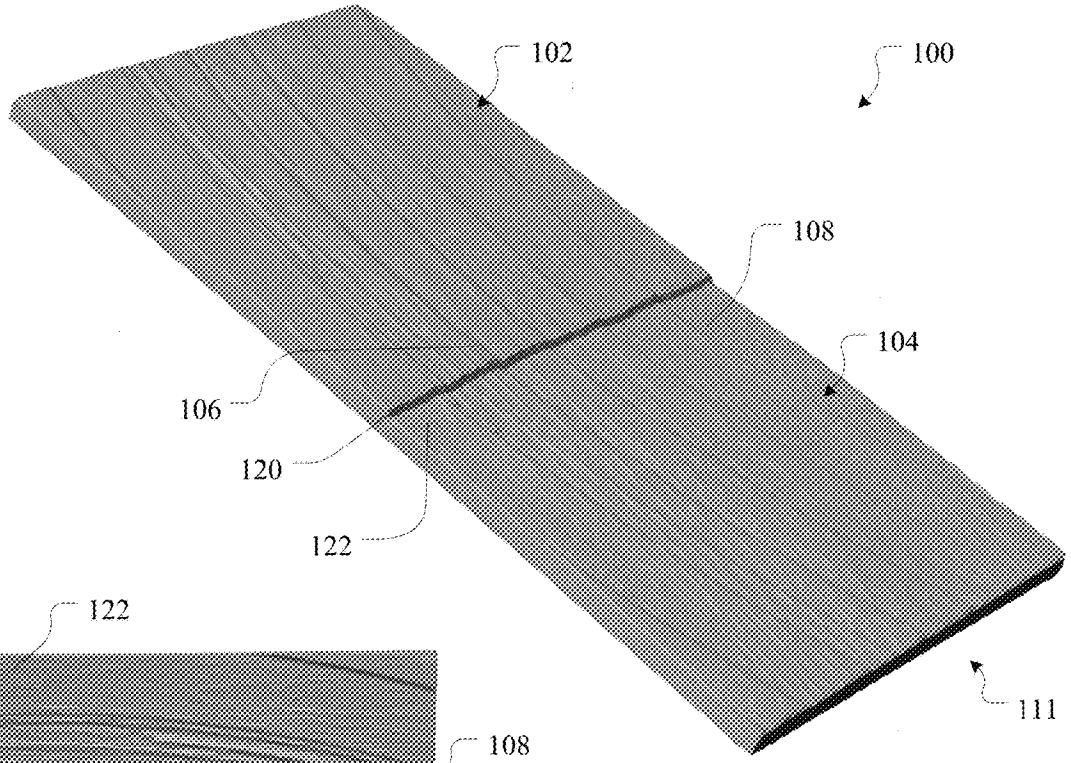
FIGS. 1A-1D depict a cementitious article exhibiting a texture pattern imparting the appearance of circular saw marks.
Figure 1B:
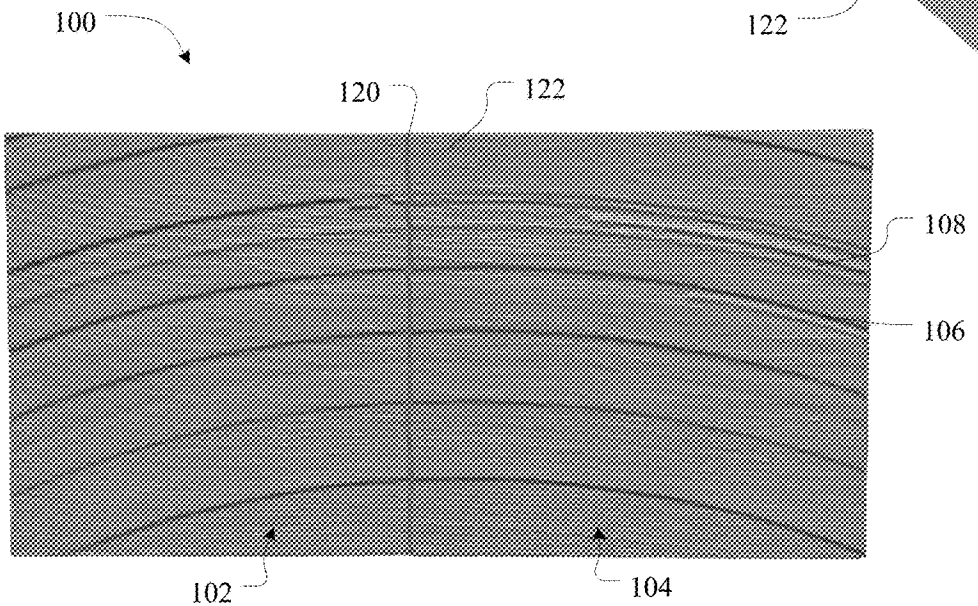
Figure 1C:
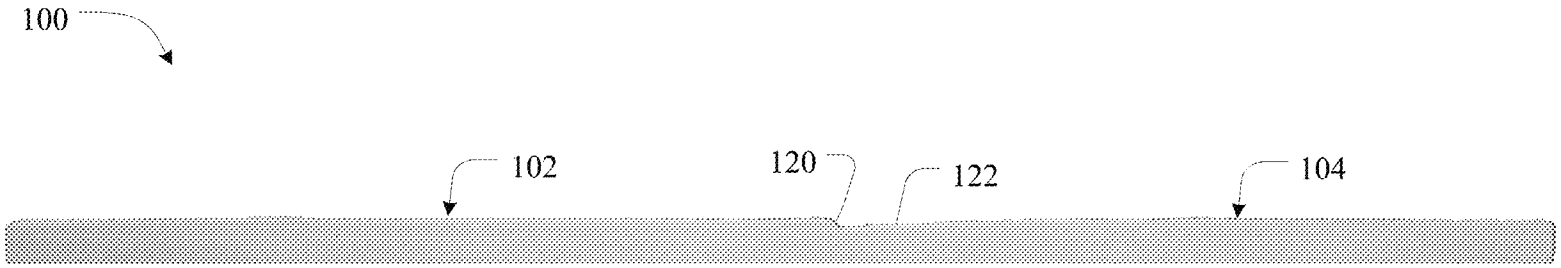
Figure 1D:
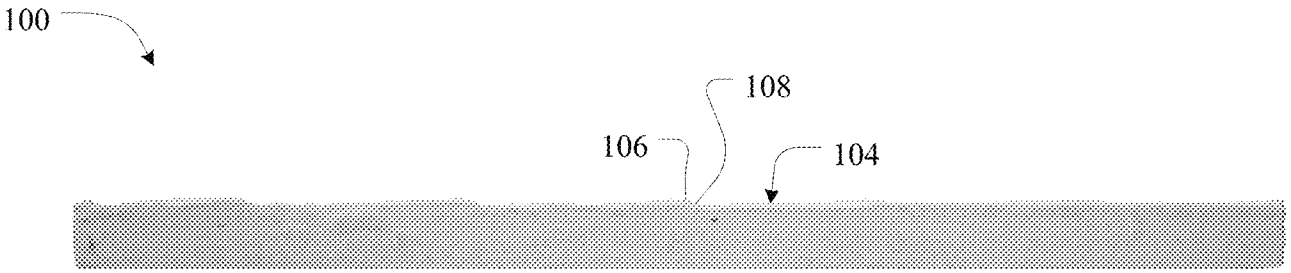

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be used, and other changes may be made, without departing from the spirit or scope of the subject matter presented herein. It will be readily understood that the embodiments of the present disclosure, as generally described herein and illustrated in the figures, can be arranged, substituted, combined, and designed in a wide variety of different configurations, all of which are explicitly contemplated and made part of this disclosure.

It has long been difficult to replicate the aesthetic and functional characteristics of natural wood shingles and sidings with non-wood products and manufacturing methods. Utilizing non-wood materials, such as cementitious materials including fiber cement, for shingles and sidings for building structures can improve durability, especially in geographic locations subject to harsh weather conditions that often deteriorate wood-based products and otherwise reduce the life expectancy of such products. The embodiments described herein, alone or in combination, solve problems arising from these attempts and achieve the desirable characteristics of natural wood cladding products while employing more durable, non-wood products.

Natural wood cladding such as wood shingles, when installed on walls (for example), typically have a thick shadow line appearing on underlapped cladding. This shadow line is a result of the blockage of light caused by the bottom edge of an overlapped cladding as it appears on an underlapped cladding. For example, a natural western red cedar wood shingle can have a thick shadow line formed by a 7/16 inch edge. Natural eastern white cedar can also have a thick shadow line formed by a typical 3/8 inch thick drip edge. Thicker shadow lines generally give off a perception of a more solid siding material. Thicker shadow lines may generally be associated with higher end building products and/or higher end buildings. Typically, natural wood shingles are produced with a tapered profile. When assembled, the thicker ends overlap thinner tapered ends, enabling a lower net shingle thickness. However, it can be difficult to produce and/or install similarly tapered shingles of cementitious materials such as fiber cement.

Natural wood cladding elements may also be lighter than fiber cement products. This weight difference not only makes construction more difficult (for example, for construction workers), but also results in greater aggregate gravity loads imparted on structural members and thus a need for structural members of greater strength. For example, cedar is roughly 2 to 2.5 pounds per square foot. Fiber cement of 1/4 inch thickness, on the other hand, is approximately 2.5-3.5 pounds per square foot, and 5/16 inch thick fiber cement is approximately 3.8 to 4.2 pounds per square foot.

Generally described, this disclosure provides systems and methods for improved shingle and cladding systems. Some embodiments include siding and/or cladding elements with various substrate thicknesses, one or more recessed portions, including, for example, a step and a cove. A portion of the siding and/or cladding elements can be locally thin and/or can reduce in thickness along a given length of the siding and/or cladding element, forming a recessed portion. A step cove can exist at an end of the recessed portion, or cove, forming a more abrupt increase in thickness to the full substrate thickness. When a subsequent siding and/or cladding element is installed atop or otherwise overlaps an underlying siding and/or cladding element, a drip edge of the subsequent element can form, along with the stepped cove, a lengthened shadow line appearing at least partially on the recessed portion of the underlying element, as well as an increased drip edge depth for enhanced drainage functionality. This configuration can advantageously achieve the desirable aesthetic and functional characteristics of natural wood tapered/beveled shingles and/or cladding, but with a manufactured non-wood material. As some non-wood materials, such as fiber cement, may generally be heavier than wood shingle, the embodiments described herein may allow for a cementitious article to replicate the appearance and drainage of wood shingle, with reduced weight and overall material usage in production, may involve less production effort/energy, and because of the reduction in material, may produce less eventual waste.

To maintain uniformity and consistency, the manufacturing process disclosed herein provides for the shingle and/or siding pattern to be imprinted and carried into the "stepped cove" area of each manufactured fiber cement element. As shown and discussed herein, the "stepped cove" can comprise a step and a recessed portion or cove. Maintaining the pattern through the fiber cement element and recessed cove area may be advantageous, as this pattern mimics the natural appearance and aesthetic features of natural wood elements. This imprinted pattern is viewed by customers and onlookers observing the product in its finished state and may contribute to the complete aesthetic appearance. This disclosure contemplates a fiber cement shingle and/or siding element manufacturing process which imparts the stepped cove onto the fiber cement element during the manufacturing process before, during, and/or after the time the pattern is put on or imparted onto the fiber cement element. Thus, it is contemplated that a manufacturing process can impart the pattern onto a fiber cement shingle and/or siding element while also imparting a stepped cove on the element.

In addition to the unique process of imparting the stepped cove before, during, and/or after the time when the pattern is imprinted on the fiber cement elements during the manufacturing process, the systems and methods disclosed herein provide several other advantages over existing cladding systems. The systems and methods disclosed herein create an improved drip edge shadow line thickness over various base substrate thicknesses where non-wood products are employed for overlapping elements, such as shingle and/or siding elements. The systems and methods disclosed herein also provide siding and/or cladding elements comprised of non-wood materials which can have reduced weight and comprise less overall material, while still affording the improved drip edge shadow line advantage previously discussed. For example, a 5/16 inch thick shingle with a 1/16 inch stepped cove feature creates a 3/8 inch shadow line yet is lighter than a ⅜ inch square profile shingle with the same length shadow line. This weight-reduction benefit also provides an added benefit of increasing installation time. The reduction in overall raw material usage reduces cost and also leads to less waste when the product life-cycle eventually completes. The stepped cove feature and associated method of manufacturing can also increase the sheet machine throughput (e.g., by running a ¼ inch thick plank vs. a 5/16 inch plank).

While this disclosure refers to shingle and siding products, the systems and methods discussed herein could be used with other products that can be lapped. Other products that utilize lapping can benefit from the features and methods described herein, such as the stepped cove and/or associated manufacturing process discussed herein. These and other advantages of various embodiments will be apparent from the description that follows.

Although the preceding and subsequent sections of this disclosure may discuss or refer to fiber cement material employed in the system and/or method of elements discussed herein, other materials are equally contemplated to be used. For example, other non-wood materials are contemplated to be used to create the lapping elements discussed herein. Further, a combination of non-wood and wood materials, for example, a composite material, are also contemplated to be used.

Moreover, the present disclosure provides coating systems for cementitious articles such as fiber cement that incorporate a combination of texture patterns and coating compositions that together create the natural appearance of sawn cut wood. In some embodiments, the coated cementitious article has the appearance of sawn cut cedar wood. For example, the coated fiber cement article may have the appearance of sawn cut western red cedar, sawn cut eastern grey cedar, or other varieties. In some embodiments, the cementitious articles include fiber cement shingles, shakes, or half rounds.

The cementitious articles may be prepared with a complementary set of three-dimensional textured patterns to replicate wood-like patterns. For example, the fiber cement articles provided herein may include one or more features that are commonly found in assortments of natural cedar shingles. For example, in some embodiments, the fiber cement articles may have patterns including, but not limited to, grain with circular saw marks, straight or vertical grain, raised fibers, and/or open flat grain called cathedrals. In some embodiments, the diameter of the circular saw marks are in the range of 42"-46" which can be replicated by the fiber cement embossing process and impart the appearance of natural sawn cut cedar shingles.

Tinted basecoats and topcoats are designed to be applied to a fiber cement article with the wood like texture patterns to highlight certain areas of the texture patterns so that the shingle looks like stained wood with varied colors. These highlights may be created and/or enhanced by the depth of these patterns, which may range from about 0.045" to about 0.085". In some embodiments, the basecoat and topcoat colors can be designed to reproduce the inherent colors in natural cedar wood, to provide visual color variation, and/or to accentuate the texture patterns. In some embodiments, the topcoat colors can be designed to enhance the underlying basecoat colors and can be tailored to provide certain visual characteristics of cedar wood such as dark black patches or streaks of red tannin.

In some embodiments, the fiber cement article may be coated with a primer. In some embodiments, a two-part waterborne epoxy sealer may be used as a primer for the basecoat/topcoat coating system to impart weathering, appearance and durability. Two-part waterborne epoxy sealers may be used, for example, if one-part waterborne acrylic primers do not give acceptable durability, paint adhesion or final appearance. The basecoat and topcoat paints may be acrylic heat cured paints, which can be applied as factory finishes to achieve the desired paint durability, adhesion and final appearance characteristics of natural cedar wood.

In some embodiments, the overall coating system comprises a combination of the new cementitious article patterns with specifically designed basecoat and topcoat paint systems applied to them. In some embodiments, the waterborne coating system application process comprises: (1) application of a two-part waterborne epoxy sealer; (2) application of one or more solid basecoats; and (3) application of one or more topcoats. In some embodiments, the basecoat and topcoat colors are designed to simulate the appearance of natural wood including, but not limited to, eastern grey cedar and western red cedar. In some embodiments, the topcoat is transparent or semi-transparent. In some embodiments, the topcoat is non-transparent.

In order to produce the natural look of cedar wood on a fiber cement article, both the texture pattern and the coating color system can be implemented in combination to create a fiber cement shingle that looks like a cedar wood shingle. The basecoat colors described herein are designed to match the majority of the natural cedar wood colors. For example, in some embodiments, the basecoat is light grey in color. In some embodiments, the basecoat is medium grey in color. In some embodiments, the basecoat is dark grey in color. In some embodiments, the basecoat is light tan in color. In some embodiments, the basecoat is medium tan in color. In some embodiments, the basecoat is dark brown in color. Two or more of these basecoats may be combined to produce additional color configurations. In some embodiments, a fiber cement article comprises one basecoat and one topcoat. In some embodiments, a fiber cement article comprises one or more basecoats (such as two or three basecoats) and/or one or more topcoats.

In some embodiments, a set of shingles (e.g., a bundle, system, kit, etc.) may include a randomized or pseudo-randomized assortment of shingle texture patterns and/or colors which may be installed such that many or most adjacent shingles differ in color, texture, or both. For example, the set of shingles may include two, three, four, or more colors, some or all of which may be applied to the shingles such that each of the texture patterns is included in a plurality of different colors. In the set of shingles, shingles with the same texture pattern may have different colors or different shades of the same color. Accordingly, the combinations of colors and texture patterns described herein may advantageously create a more natural look when installed and avoid from appearing overly uniform or forming any discernible patterns characteristic of man-made shingles.

Cementitious Article Texture Patterns

As described above, a variety of texture patterns may be incorporated into a set of shingles to impart the appearance of natural sawn cut wood, both in individual shingles and in an assortment of shingles for installation. The new patterns include circular saw marks (for example, with a diameter of 42" to 46" (106.68 cm to 116.84 cm, corresponding to a radius of curvature of 21" to 23", or 53.34 cm to 58.42 cm)), raised fibers that follow grain lines, straight or edge grain, and flat or open cathedrals. The depths of the texture patterns may vary. For example, in some embodiments the texture depth (also referred to herein as the "depth of relief") ranges from 0.045" to 0.085" (1.143 mm to 2.159 mm). These four different textures are designed to create a varied reflection, such as in sunlight or artificial light, for a painted cedar look when coated with paint color. However, the new texture pattern shingle alone may not necessarily give the desired stained eastern or western cedar look with conventional paints. Thus, the novel coatings described herein below may be applied as well in combination with these texture patterns to produce a high-quality stained cedar look.

With reference to FIGS. 1A-5B, shingles with textured patterns and coating systems designed to replicate natural cedar shingles will now be described in greater detail. FIGS. 1A-1D depict an example shingle 100 with a circular saw mark texture. FIG. 1A is a perspective view of the shingle 100, FIG. 1B is a front elevation view, FIG. 1C is a left side profile view, and FIG. 1D is a bottom plan view of the shingle 100. The shingle 100 is generally defined by an upper section 102 and a lower section 104 disposed below the upper section 102 when the shingle 100 is installed vertically against a building substrate. The upper section 102 and the lower section 104 are separated by a step 120, with a recessed portion or cove 122 of the lower section 104 gradually increasing in thickness such that a terminal portion 111 of the lower section 104 has a thickness substantially equal or equal to a thickness of the upper section 102. The step 120 and recessed portion 122 are discussed in greater detail below with reference to FIGS. 6-9. The shingle 100 includes a variety of peak areas 106 and valley areas 108 arranged in a shape approximating a series of circular saw marks. As shown, the shingle 100 has a thickness at the peak areas 106 that is greater than a thickness of the shingle 100 at the valley areas 108. A difference between the thickness of the shingle 100 at the peak areas 106 and the thickness of the shingle 100 at the valley areas 108 can range from 0.045" to 0.085" (1.143 mm to 2.159 mm) for example. In one embodiment, each of the circular saw marks has a radius of 21"-23". The shingle 100 may comprise any cementitious material with or without fiber reinforcement, or other suitable cladding material, such as vinyl, a composite material, wood-based material, or the like. For example, the shingle 100 can comprise fiber cement.

Figure 2A:
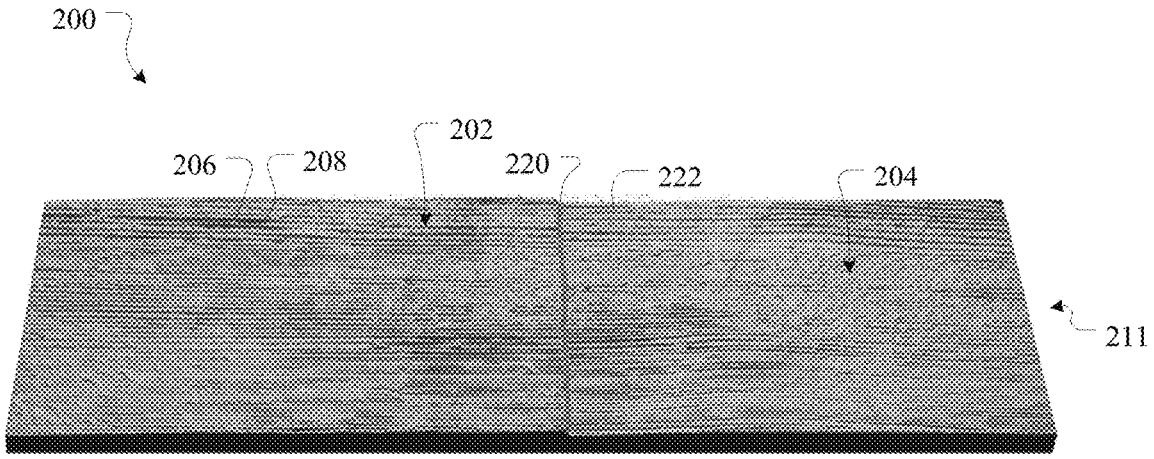
FIGS. 2A-2D depict a cementitious article exhibiting a texture pattern imparting the appearance of raised fibers that follow grain lines.
Figure 2B:
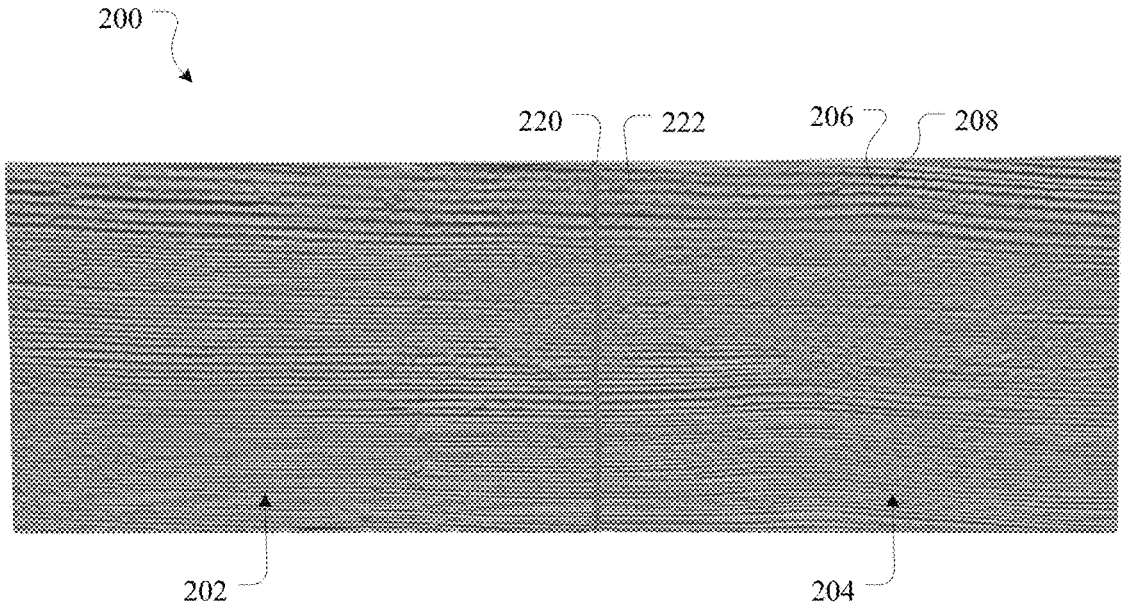
Figure 2C:
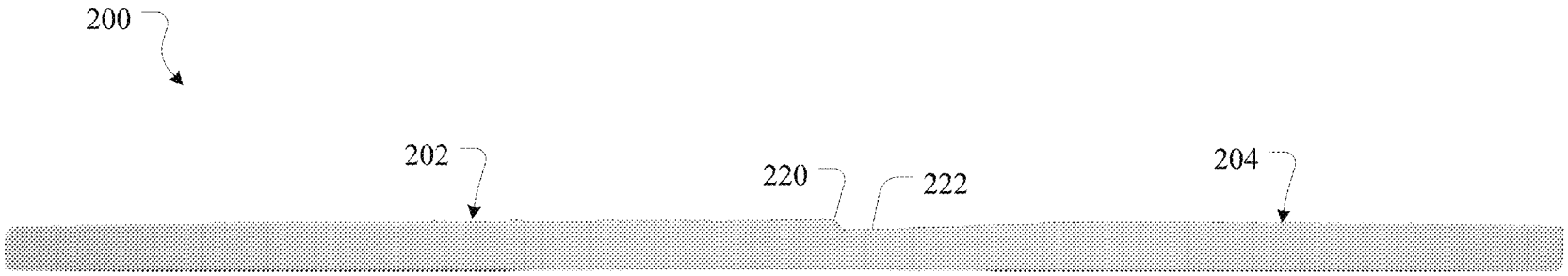
Figure 2D:
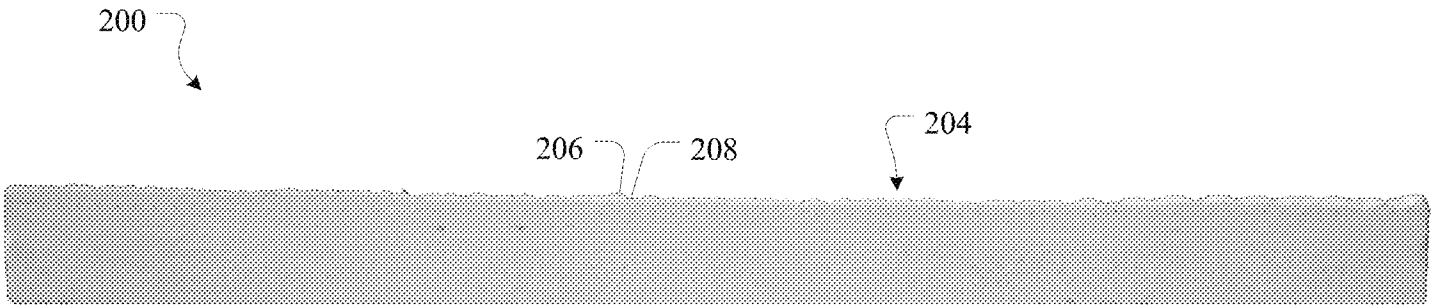

FIGS. 2A-2D depict an example shingle 200 with a texture of raised fibers that follow grain lines. FIG. 2A is a perspective view of the shingle 200, FIG. 2B is a front elevation view, FIG. 2C is a left side profile view, and FIG. 2D is a bottom plan view of the shingle 200. Similar to the shingle 100 of FIGS. 1A-1D, the shingle 200 is generally defined by an upper section 202 and a lower section 204 disposed below the upper section 202 when the shingle 200 is installed vertically against a building substrate. The upper section 202 and the lower section 204 are separated by a step 220, with a recessed portion or cove 222 of the lower section 204 gradually increasing in thickness such that a terminal portion 211 of the lower section 204 has a thickness substantially equal or equal to a thickness of the upper section 202. The step 220 and recessed portion 222 are discussed in greater detail below with reference to FIGS. 6-9. The shingle 200 includes a variety of peak areas 206 and valley areas 208 arranged in a shape approximating a series of raised fibers following grain lines, for example, as would appear in natural sawn cut cedar. As shown, the shingle 200 has a thickness at the peak areas 206 that is greater than a thickness of the shingle 200 at the valley areas 208. A difference between the thickness of the shingle 200 at the peak areas 206 and the thickness of the shingle 200 at the valley areas 208 can range from 0.045" to 0.085" (1.143 mm to 2.159 mm) for example. The shingle 200 may comprise any cementitious material with or without fiber reinforcement, or other suitable cladding material, such as vinyl, a composite material, wood-based material, or the like. For example, the shingle 200 can comprise fiber cement.

Figure 3A:
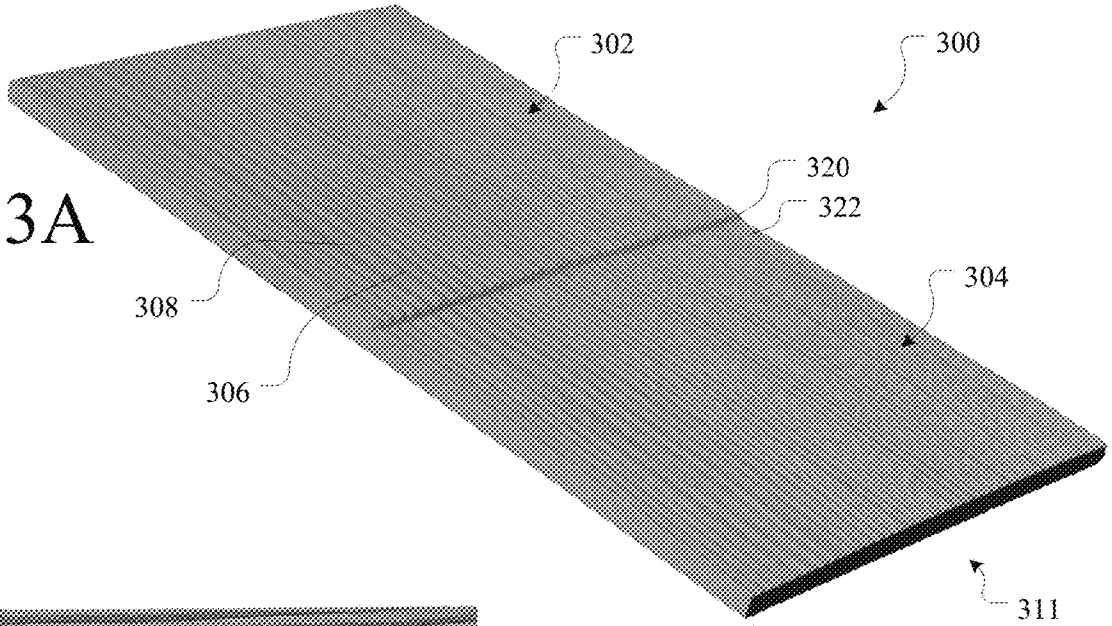
FIGS. 3A-3D depict a cementitious article exhibiting a texture pattern imparting the appearance of straight or edge grain.
Figure 3B:
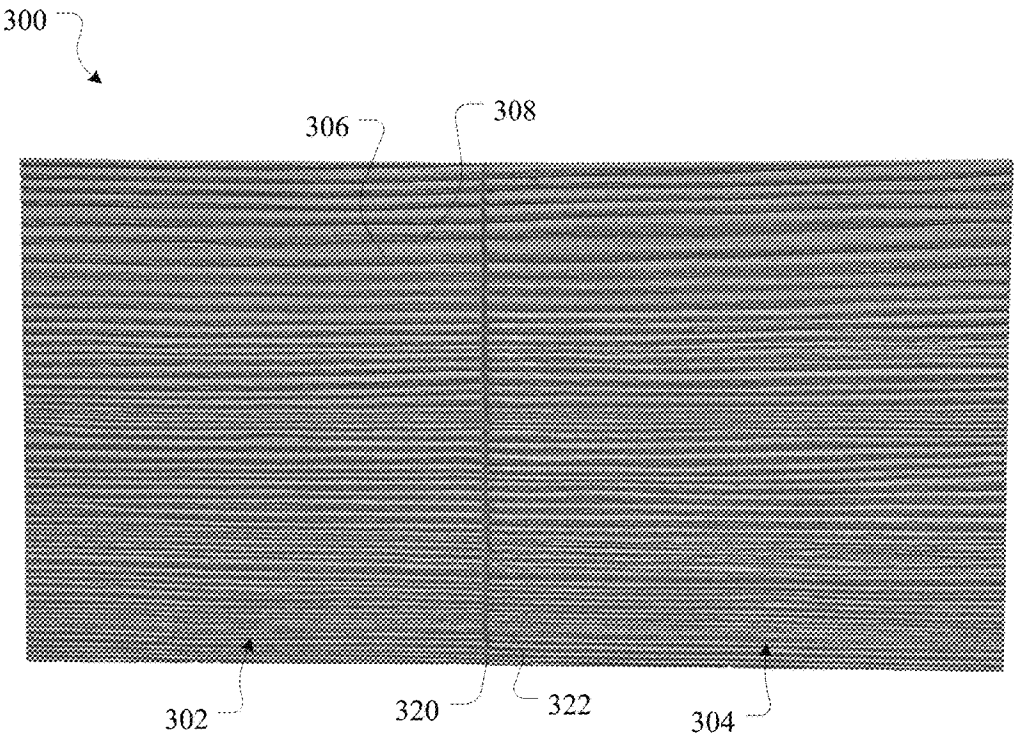
Figure 3C:
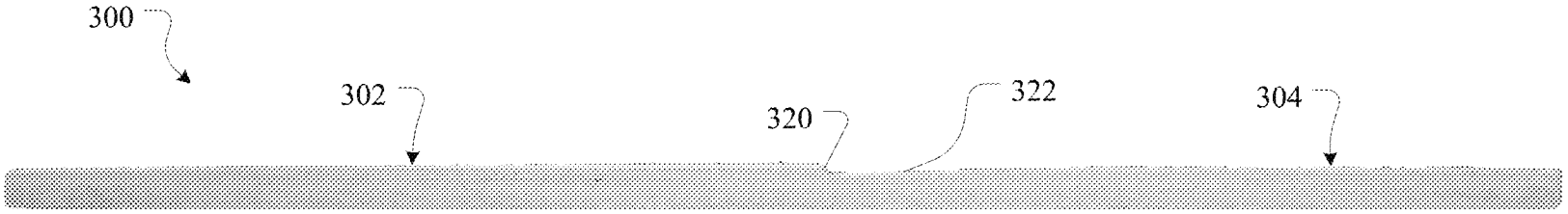
Figure 3D:
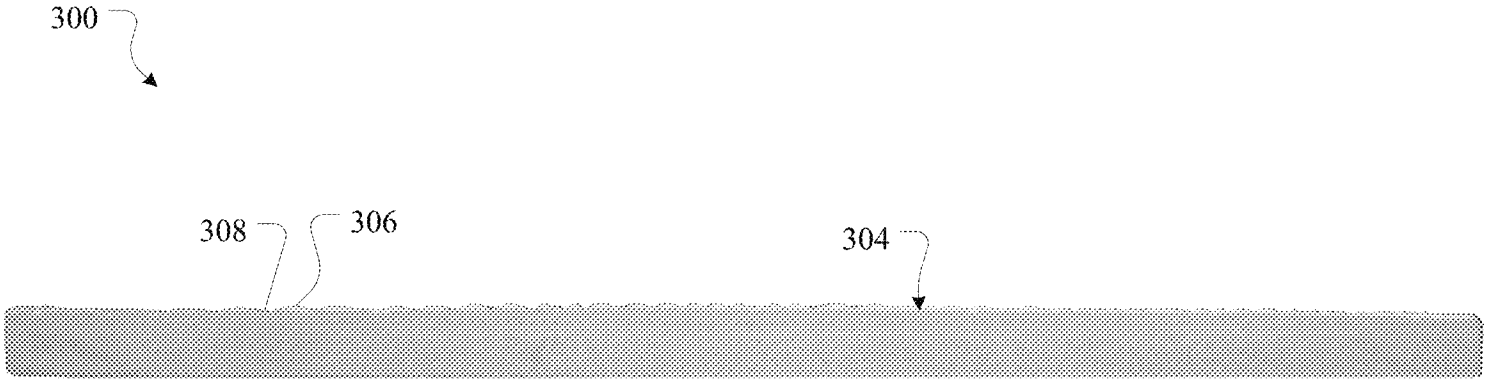

FIGS. 3A-3D depict an example shingle 300 with a straight grain or edge grain texture. FIG. 3A is a perspective view of the shingle 300, FIG. 3B is a front elevation view, FIG. 3C is a left side profile view, and FIG. 3D is a bottom plan view of the shingle 300. Similar to the shingles 100 and 200 of FIGS. 1A-2D, the shingle 300 is generally defined by an upper section 302 and a lower section 304 disposed below the upper section 302 when the shingle 300 is installed vertically against a building substrate. The upper section 302 and the lower section 304 are separated by a step 320, with a recessed portion or cove 322 of the lower section 304 gradually increasing in thickness such that a terminal portion 311 of the lower section 304 has a thickness substantially equal or equal to a thickness of the upper section 302. The shingle 300 includes a variety of peak areas 306 and valley areas 308 arranged in a shape approximating a series of straight or edge grain lines. As shown, the shingle 300 has a thickness at the peak areas 306 that is greater than a thickness of the shingle 300 at the valley areas 308. A difference between the thickness of the shingle 300 at the peak areas 306 and the thickness of the shingle 300 at the valley areas 308 can range from 0.045" to 0.085" (1.143 mm to 2.159 mm) for example. The shingle 300 may similarly comprise any cementitious material with or without fiber reinforcement, or other suitable cladding material, such as vinyl, a composite material, wood-based material, or the like. For example, the shingle 300 can comprise fiber cement.

Figure 4A:
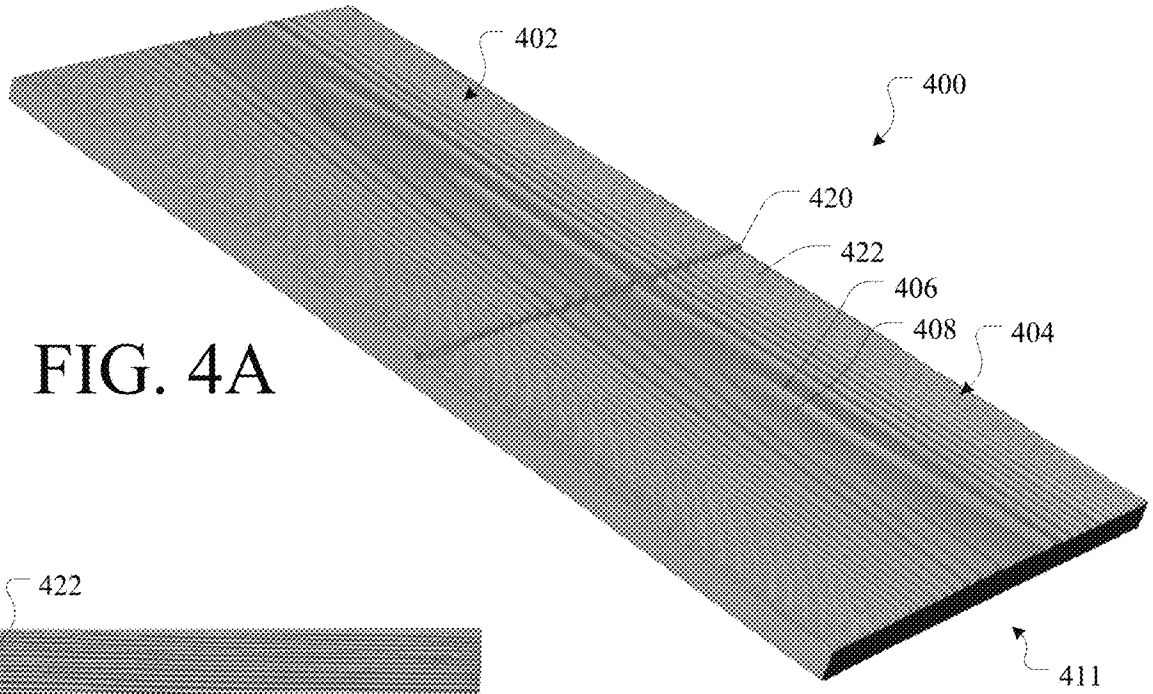
FIGS. 4A-4D depict a cementitious article exhibiting a texture pattern imparting the appearance of flat or open cathedrals.
Figure 4B:
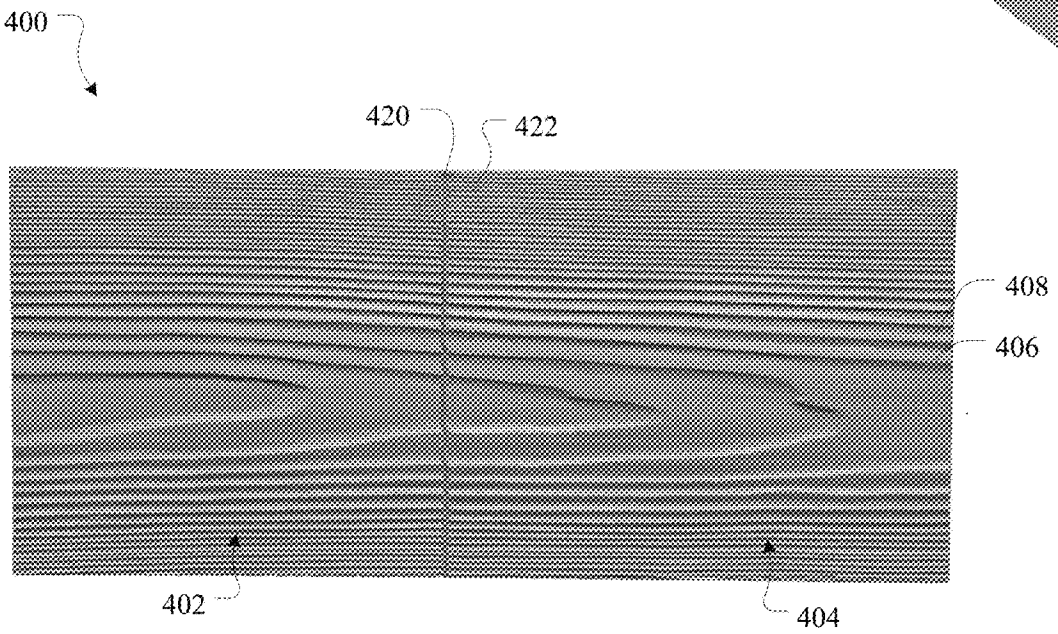
Figure 4C:
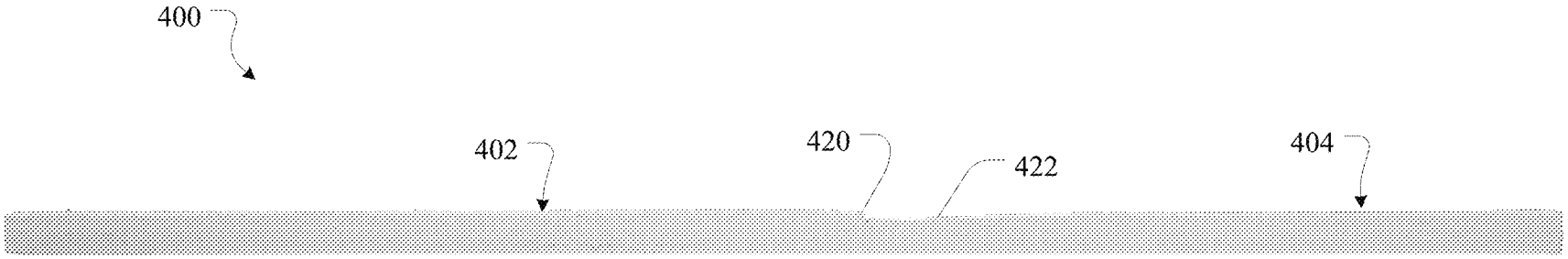
Figure 4D:
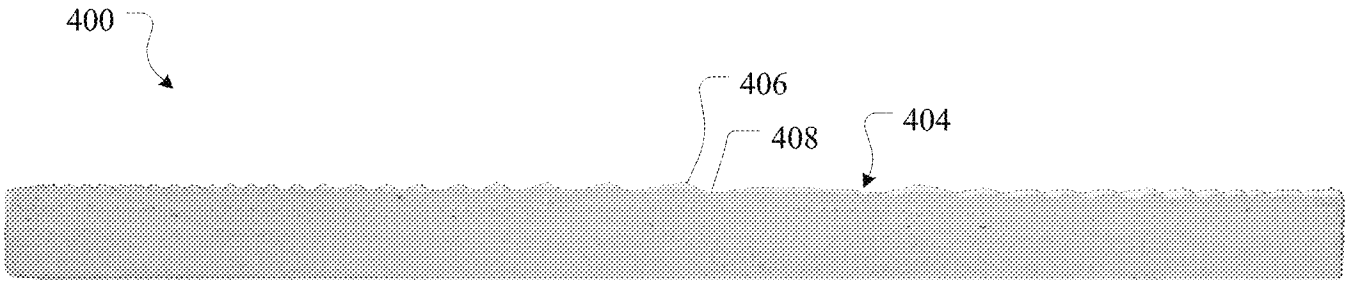

FIGS. 4A-4D depict an example shingle 400 with a cathedral texture. FIG. 4A is a perspective view of the shingle 400, FIG. 4B is a front elevation view, FIG. 4C is a left side profile view, and FIG. 4D is a bottom plan view of the shingle 400. The shingle 400 is generally defined by an upper section 402 and a lower section 404 disposed below the upper section 402 when the shingle 400 is installed vertically against a building substrate. The upper section 402 and the lower section 404 are separated by a step 420, with a recessed portion or cove 422 of the lower section 404 gradually increasing in thickness such that a terminal portion 411 of the lower section 404 has a thickness substantially equal or equal to a thickness of the upper section 402. The shingle 400 includes a variety of peak areas 406 and valley areas 408 arranged in a shape approximating a series of flat or open cathedrals. As shown, the shingle 400 has a thickness at the peak areas 406 that is greater than a thickness of the shingle 400 at the valley areas 408. A difference between the thickness of the shingle 400 at the peak areas 406 and the thickness of the shingle 400 at the valley areas 408 can range from 0.045" to 0.085" (1.143 mm to 2.159 mm) for example. The shingle 400 may comprise any cementitious material with or without fiber reinforcement, or other suitable cladding material, such as vinyl, a composite material, wood-based material, or the like. For example, the shingle 400 can comprise fiber cement.

Figure 5A:
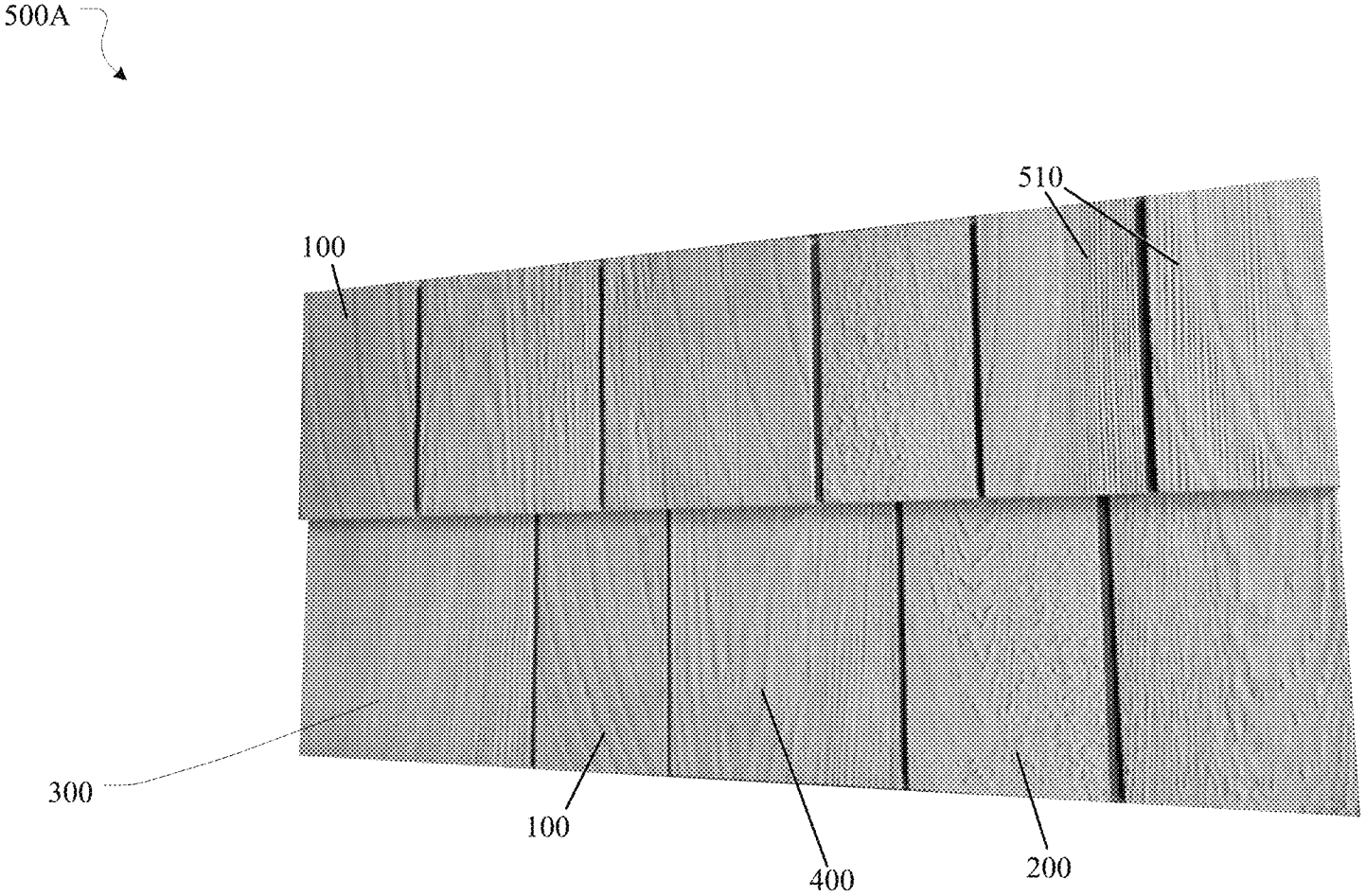
FIGS. 5A and 5B depict arrays of cementitious articles exhibiting a combination of texture patterns to approximate the appearance of natural wood shingles.
Figure 5B:
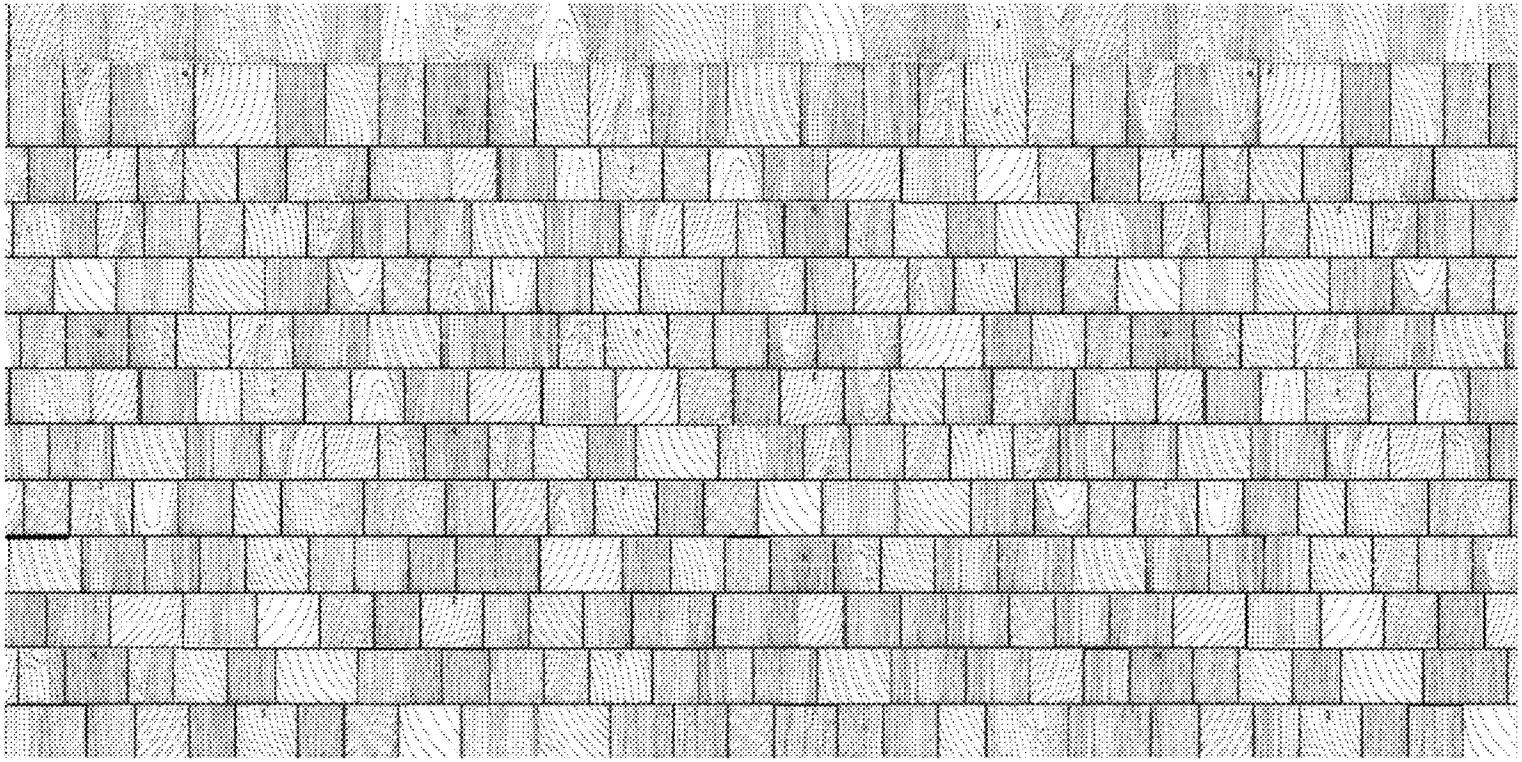

FIGS. 5A and 5B illustrate example combinations of textured shingles, for example, the shingles 100, 200, 300, 400 depicted in FIGS. 1A-4D, as installed on the exterior of a building as a cladding. FIG. 5A depicts a section 500A of a shingle cladding array (for example, a fiber cement cladding array) illustrating an aesthetic advantageous effect of combining a plurality of different shingle textures in adjacent shingles. The section 500A includes shingles 100 with circular saw mark texture, shingles 200 with raised fiber texture, shingles 300 with straight or edge grain texture, and shingles 400 with cathedral texture. It will be appreciated that the exact arrangement of textural features (e.g., location, spacing, depth, orientation, etc.) may vary somewhat between examples of shingles of a particular texture, due to various manufacturing aspects (e.g., cutting shingles from a larger section of textured material).

The section 500A further includes shingle(s) 510 having a combination of the textures described above. For example, the shingle(s) 510 at the upper right corner of the section 500A includes circular saw marks and straight or edge grain texture. Thus, the combination of shingles 100, 200, 300, 400, 510 in the section 500A appears to have a random or pseudo-random assortment consistent with the appearance of an example set of natural wood shingles.

In some embodiments, shingles 100, 200, 300, 400, 510 may be manufactured and installed in a row or section of shingles, rather than as individual shingles. For example, in the section 500A depicted in FIG. 5A, the lower row of shingles may comprise a single cementitious article connected by a contiguous strip at an upper portion of the article, such that the article may be installed to the building substrate as a single piece. After installation of the article, the upper row of shingles may be installed at least partially overlapping the one-piece lower row of shingles so as to conceal the contiguous strip.

In some embodiments, such a single-piece cementitious article may be manufactured in a strip, with keyways, or gaps, cut into a lower section of the strip to create the appearance of individual shingles. The keyways may extend less than the full height of the article to retain a contiguous strip across the length of the article. In some embodiments, the keyways cut into a single article may have a standard width, or may have variable widths within the same article to create the appearance of irregular shingle widths and/or spacing.

FIG. 5B depicts a larger section 500B of shingles as applied to a building substrate. The larger section 500B illustrates the aesthetic improvements that may be achieved by covering a wall with shingles having a random or pseudo-random variety of textures formed thereon. The combination of shingles shown in FIG. 5B, in which adjacent shingles may or may not have similar texture patterns, creates an appearance of natural sawn cut wood shingles. As will be described in greater detail below, this appearance may be enhanced by the use of a variety of coatings to approximate natural variation of wood shingles.

Enhanced Drip Edge and Shadow Line

FIG. 6 illustrates an embodiment of an example cladding element 600 including the enhanced drip edge and shadow line features described herein. As discussed above, the cladding element 600 discussed herein can comprise a wood or non-wood material, for example, a cementitious material such as fiber cement, or another material such as vinyl, composite materials, or the like. In the example of FIG. 6, the cladding element 600 has a profile consistent with the shingles 100, 200, 300, 400, 510 depicted and described with reference to FIGS. 1A-5B. Similar to the example shingles described above, the cladding element 600 includes an upper section 602 and a lower section 604. Between the upper section 602 and the lower section 604, the cladding element 600 includes a step 620 and a recessed portion 622 or cove.

The cladding element 600 comprises a cladding material having a thickness. As discussed above, the cladding element 600 can have an upper section 602 and a lower section 604. The upper section 602 has a thickness 628 and the lower section 604 has a thickness 629. The thicknesses 628, 629 of the cladding element 600 can be any of various thicknesses, such as 0.125" (0.3175 cm), 0.25" (0.635 cm), 0.3125" (0.79375 cm), 0.5" (1.27 cm), 0.625" (1.5875 cm), 0.75" (1.905 cm), 1" (2.54 cm), 1.25" (3.175 cm), 1.5" (3.81 cm), or any value therebetween, or any range bounded by any combination of these values, although values outside these ranges may also be used. In some embodiments, the thickness 628 of the upper section 602 is greater than the thickness 629 of the lower section 604. Alternatively, the thickness 628 of the upper section 602 can be less than the thickness 629 of the lower section 604. In some embodiments, the thickness 628 of the upper section 602 can be equal or substantially equal to the thickness 629 of the lower section 604.

The step 620 generally comprises a transitional surface 621 (see FIG. 6B) of the cladding element 600 between the thickness 628 of the upper section 602 and a reduced thickness, which can be a thickness 631 of a beginning portion or end of the recessed portion or cove 622. Thickness 631 of the recessed portion or cove 622 can be a minimum thickness of the cladding element 600. The step 620 can be located near the middle of cladding element 600 between the upper section 602 and the lower section 604. For example, the step 620 can be positioned at a location of the cladding element 600 that is at or proximate to half a height of the cladding element 600. Alternatively, the step 620 can be positioned closer to a top or first end of the cladding element 600 than to a bottom or second end of the cladding element 600 and vice versa. The step 620 and/or recessed portion 622 may comprise a top portion of the lower section 604 of the cladding element 600, which can be adjacent to a bottom portion or end of the upper section 602. However, it will be appreciated that the step 620 and cove 622 may be located at any position along the vertical height or length of the cladding element 600.

The transitional surface 621 of step 620 can be angled from a plane of the upper section 602, a plane of the lower section 604, and/or a plane of a face opposite the upper section 602 and/or the lower section 604 of the cladding element 600 (for example, rear face 603) at an angle $\theta_1$ (see FIG. 6A-6B) of 20 degrees, 30 degrees, 40 degrees, 45 degrees, 50 degrees, 60 degrees, 70 degrees, 80 degrees, 90 degrees, or any value therebetween, or any range bounded by any combination of these values, although values outside these ranges can be used in some cases. For example, the transitional surface 621 of step 620 can be angled from a plane of the upper section 602, a plane of the lower section 604, and/or a plane of a face opposite the upper section 602 and/or the lower section 604 of the cladding element 600 (for example, rear face 603) at an angle $\theta_1$ of between 30 and 90 degrees, between 45 and 85 degrees, between 50 and 80 degrees, between 55 and 75 degrees, between 60 and 70 degrees, or any value or range therebetween, although values outside these ranges can be used in some cases.

The step 620 is generally defined by a depth 626. The depth 626 of the step 620 can be, for example, 0.0625" (0.15875 cm), 0.125" (0.3175 cm), 0.25" (0.635 cm), 0.5" (1.27 cm), 0.75" (1.905 cm), or any value therebetween, or any range bounded by any combination of these values, although values outside these ranges can be used, for example, depending on the thickness of the cladding element 600 (for example, depending on the thickness 628 of the upper section 602 and/or the thickness 629 of the lower section 604). Example combinations of cladding element thicknesses and step depths 626 are described in greater detail below.

Adjacent to the step 620, the cladding element 600 further includes a recessed portion or cove 622. The recessed portion 622 generally comprises a more gradual transitional section (relative to the transitional surface 621 of step 620) from the thickness 621 at the step 620, back to a thickness of the cladding element 600, which can be a full or maximum thickness of the cladding element 600 (such as thickness 628 and/or 629). The recessed portion 622 may be beveled, tapered, partially beveled, partially tapered, gently sloping, etc., and may comprising a single slope angle or a variable slope angle. For example, the surface of the recessed portion 622 can be angled from the plane of the upper section 602, the plane of the lower section 604, and/or the plane of a face opposite the upper section 602 and/or lower section 604 of the cladding element 600 (for example, rear face 603) at an angle $\theta_2$ (see FIG. 6B) of 0.2 degrees, 0.5 degrees, 0.7 degrees, 1 degree, 2 degrees, 3 degrees, 4 degrees, 5 degrees, 7 degrees, 10 degrees, 15 degrees, 20 degrees, 30 degrees, 40 degrees, or any value therebetween, or any range bounded by any combination of these values, although values outside these ranges can be used in some cases. In some embodiments, the surface of the recessed portion 622 can be angled from a plane of the upper section 602, a plane of the lower section 604, and/or plane of the rear face 603 of the cladding element 600 at an angle $\theta_2$ which is smaller than the angle $\theta_1$ between the step 620 and the plane of the upper section 602, the plane of the lower section 604, and/or plane of the rear face 603 of the cladding element 600.

Figures 6A, 6B:
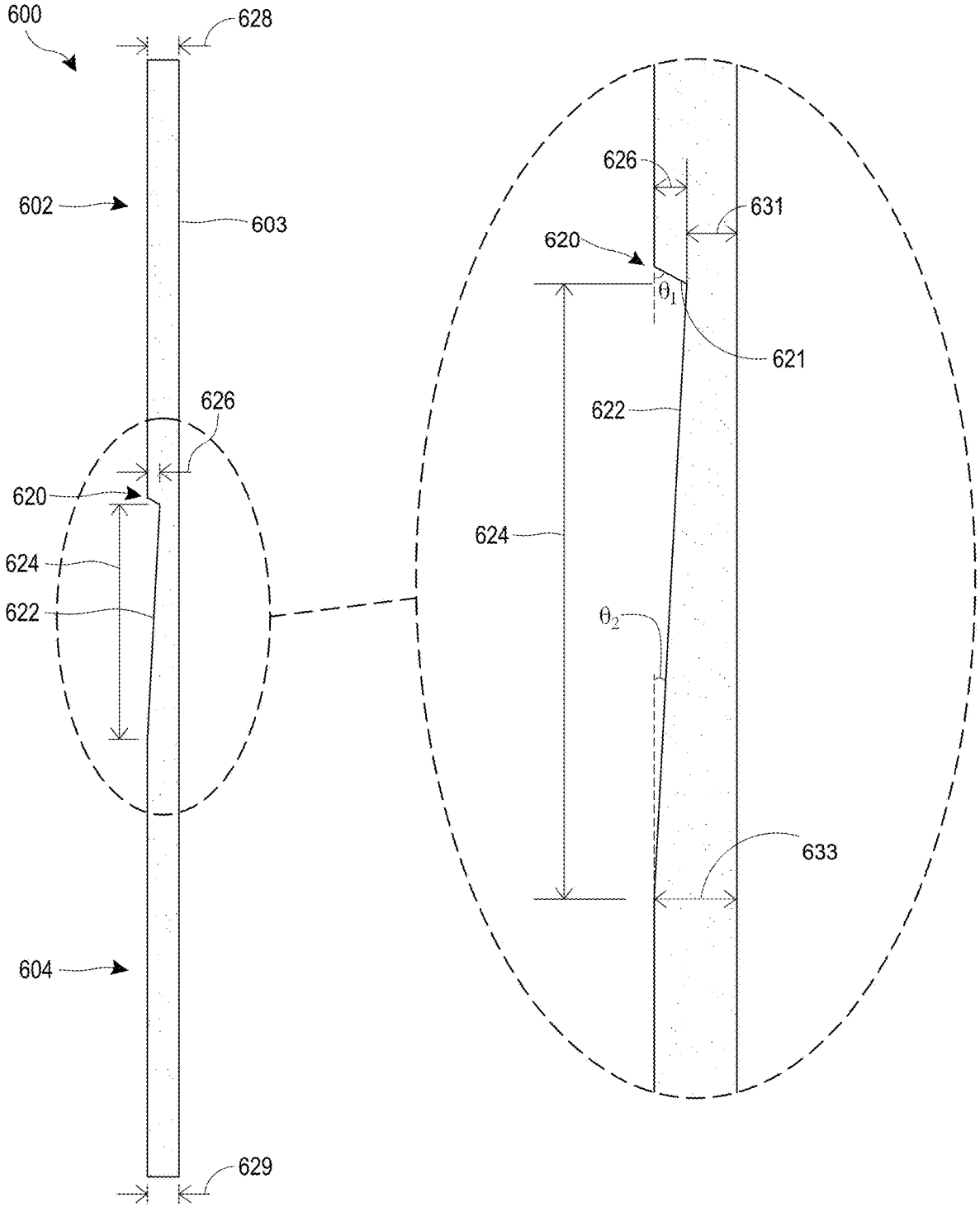
FIG. 6A illustrates a cladding element with a stepped cove in accordance with an example embodiment.
FIG. 6B illustrates an enlarged view of a portion of the cladding element of FIG. 6A.

As shown in FIGS. 6A-6B, the recessed portion 622 can extend along a recessed portion length 624 of the cladding element 600. The recessed portion length 624 can be, for example, 0.5" (1.27 cm), 0.75" (1.905 cm), 1" (2.54 cm), 1.5" (3.81 cm), 2" (5.08 cm), 3" (7.62 cm), or any value therebetween, or any range bounded by any combination of these values, although values outside these ranges can be used depending on the dimensions of the upper section 602, lower section 604, step 620, and/or depth 626 of the cladding element 600 for example. Thus, the angle $\theta_2$ of the recessed portion 622 can generally be related to the depth 626 of the step 620 and the length 624 of the recessed portion 622. The recessed portion 622 can comprise a relatively short length, wherein the angle $\theta_2$ of the surface of the recessed portion 622 relative to an outer plane of the cladding element 600 can be relatively steep in order to create the desired depth of the step 620. Alternatively, the recessed portion 622 can comprise a relatively long length, wherein the angle $\theta_2$ of the surface of the recessed portion 622 relative to the outer plane of the cladding element 600 can be slight and/or gradual in order to create the desired depth of the step 620. In some embodiments, the length of the recessed portion 622 is greater than the length of the step 620. In some embodiments, the recessed portion 622 comprises a greater portion of a surface of the cladding element 600 than the step 620. The cladding element 600 can comprise one or more recessed portions 622, such as one or more, two or more, three or more, five or more, six or more, or seven or more recessed portions 622, depending on the configuration of the cladding element 600 and/or combination, assembly, or lapping configuration with other cladding elements. The length 624, angle $\theta_2$, and/or surface of the recessed portion 622 can be modified by any of various pressing or imprinting structures used during the manufacturing process.

While angle $\theta_1$ as shown in FIG. 6B illustrates an angle that step 620 can be relative to the upper section 602, angle $\theta_1$ can also represent an angle that the step 620 can be relative to a face opposite the upper section 602 and/or the lower section 604 of the cladding element 600. For example, the upper section 602 can be parallel to a rear face 603 of the cladding element 600 in some embodiments. Similarly, while angle $\theta_2$ as shown in FIG. 6B illustrates an angle that the recessed portion 622 can be relative to the lower section 604, angle $\theta_2$ can also represent an angle that the recessed portion 622 can be relative to a face opposite the upper section 602 and/or the lower section 604 of the cladding element 600 (for example, rear face 603). For example, the lower section 604 can be parallel to a rear face 603 of the cladding element 600 in some embodiments. The step 620 can be disposed at an angle with respect to the recessed portion or cove 622 (see FIG. 6B). The step 620 can be angled with respect to the recessed portion or cove 622 at an angle of 50 degrees, 60 degrees, 70 degrees, 80 degrees, 90 degrees, 100 degrees, 110 degrees, 120 degrees, 130 degrees, or 140 degrees, or any value therebetween, or any range bounded by these values, although values outside these ranges can be used in some cases.

With continued reference to FIGS. 6A-6B, the depth 626 of the step 620 can be a certain percentage of the thickness 628 of the upper section 602 of the cladding element 600 and/or a certain percentage of the thickness 629 of the lower section 604 of the cladding element 600. For example, the depth 626 of the step 620 can be 5%, 10%, 20%, 30%, 40%, 50%, 60%, or 70% of the thickness 628 of the upper section 602 of the cladding element 600, or any value or range therebetween, or any range bounded by any combination of these values, although values outside these ranges can be used in some cases. The thickness 631 of an end of the recessed portion or cove 622 can be a certain percentage of the thickness 628 of the upper section 602 of the cladding element 600 and/or a certain percentage of the thickness 629 of the lower section 604 of the cladding element 600. For example, the thickness 631 of an end of the recessed portion or cove 622 can be 30%, 40%, 50%, 60%, 70%, 80%, 90%, or 95% of the thickness 628 of the upper section 602 of the cladding element 600, or any value or range therebetween, or any range bounded by any combination of these values, although values outside these ranges can be used in some cases. Keeping the depth 626 of the step 620 and/or the thickness 631 of the recessed portion or cove 622 within a certain percentage of the thickness 628 of the upper section 602 of the cladding element 600 and/or a certain percentage of the thickness 629 of the lower section 604 of the cladding element 600 can help ensure that the cladding element 600 has sufficient strength capacity, for example, to resist flexural bending and/or shear forces while also providing the advantageous benefits discussed herein (for example, the enhanced drip edge depth discussed below).

When the recessed portion 622 is angled relative to the upper section 602, the lower section 604, and/or the rear face 603 of the cladding element 600, an upper end of the recessed portion 622 that is proximate to a lower end of the upper section 602 and/or connected to the step 620 can be spaced from the rear face 603 by distance 631. Further, the step 620 can be angled with respect to the upper section 602, the lower section 604, and/or the rear face 603 of the cladding element 600 such that the step 620 comprises a smaller portion of the front face (face of cladding element 600 opposite the rear face 603) relative to the recessed portion 622.

As also shown in FIGS. 6A-6B, the recessed portion 622 can have a first end connected to the lower section 604 and a second end opposite the first end. The first end can be spaced from the rear face 603 by a first distance 633, which can be equal to the thickness 629 of lower section 604 in some embodiments. The second end of the recessed portion can be spaced from the rear face 603 by a second distance or thickness 631. The recessed portion 622 can be angled relative to the upper section 602, the lower section 604, and/or the rear face 603 of the cladding element 600 such that the first distance 633 is greater than the second distance 631. The second end of the recessed portion 622 can connect to the step 620 as shown. In some embodiments, the step 620 has a length that is smaller than a length of the recessed portion or cove 622. It is noted that the first and second distances discussed above can also be referred to as thicknesses of the cladding element 600.

Various properties and/or characteristics of the cladding element 600 can be modified to achieve a variety of styles and configurations of the cladding element 600. As discussed previously, the cladding element 600 can be imprinted with a wood pattern on a surface of the cladding element 600 (including along the recessed portion 622). It should be recognized that the features, characteristics, dimensions, and properties discussed above with reference to FIG. 6 are applicable to any type of product that can be lapped, as will be described in greater detail below with reference to FIG. 8.

Figure 7:
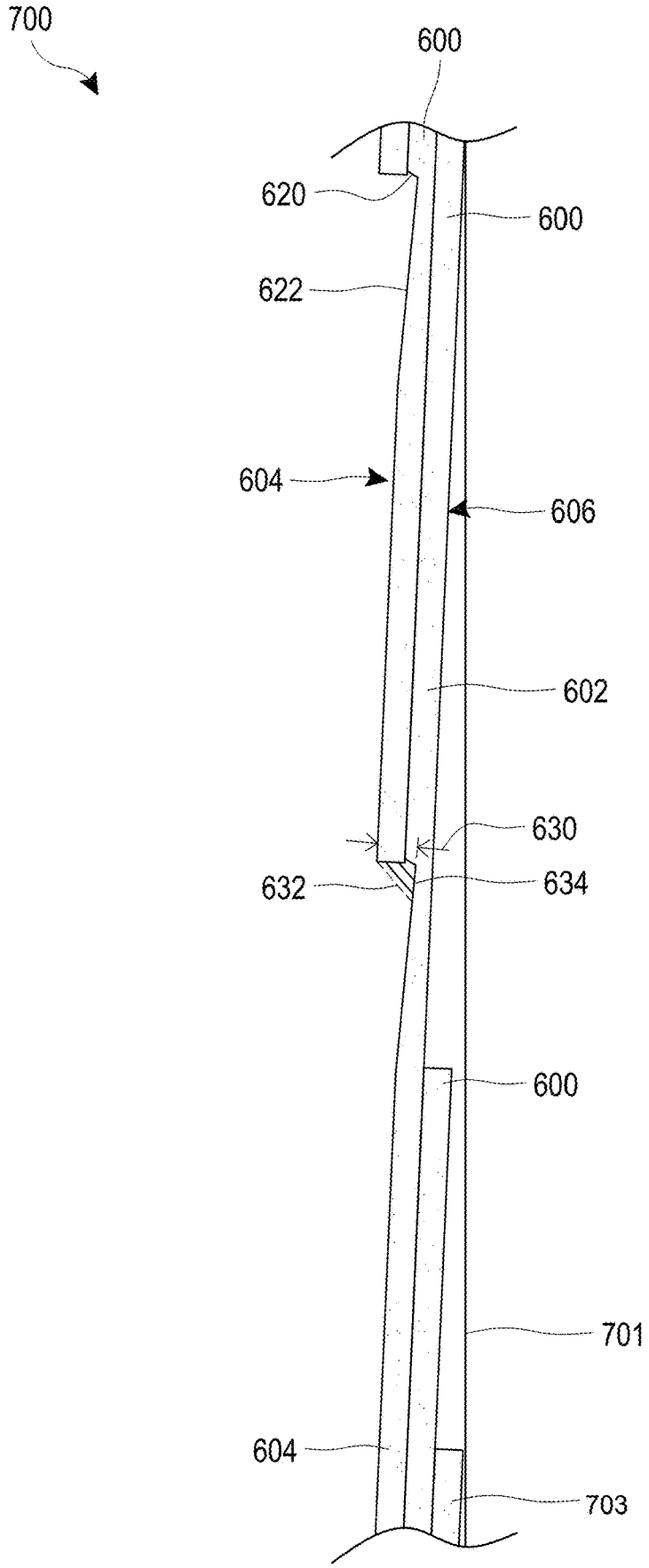
FIG. 7 illustrates multiple cladding elements with stepped coves.

FIG. 7 illustrates an assembly 700 of cladding elements 600 in an installed configuration, wherein multiple cladding elements 600 are installed in an overlapping arrangement on a building substrate 701. For example, the building substrate 701 may include one or more of structural members such as studs, a sheathing such as plywood or oriented strand board, a building wrap or weather resistant barrier, or other substrate component. As shown, the cladding elements 600 are aligned such that the lower section 604 of each overlapping cladding element 600 overlies the upper section 602 of the underlying cladding element 600, and the lower section 604 of the overlapping cladding element 600 terminates proximate the step 620 of the underlying cladding element 600. A starter strip 703 can underlay a lower portion of a first (e.g., lowest) course of shingle, with second and third courses of shingle depicted above. Accordingly, the thickness of the lower section 604 of the overlying cladding element 600 combines with the depth 626 of the step 620 of the underlying cladding element to form a larger effective drip edge, having an enhanced drip edge depth 630 greater than the maximum thickness of the cladding elements 600. For example, where a lower edge of a first cladding element 600 is laid atop an upper section 604 of a second cladding element 600 (see FIG. 7), both cladding elements 600 have a thickness equal to ¼ inch, and the depth 626 (see FIG. 6A-6B) of the step 620 is equal to 1/16 inch, the drip edge depth 630 can be equal to 5/16 inch. In such example, the drip edge depth 630 is greater than the thickness of the cladding element(s) 600 by 1/16 inch or 6.25%. As another example, where a lower edge of a first cladding element 600 is laid atop an upper section 604 of a second cladding element 600 (see FIG. 7), both cladding elements 600 have a thickness equal to ¼ inch, and the depth 626 (see FIG. 6A-6B) of the step 620 is equal to ⅛ inch, the drip edge depth 630 can be equal to ⅜ inch. In such example, the drip edge depth 630 is greater than the thickness of the cladding element(s) 600 by ⅛ inch or 12.5%. Other dimensions are possible for the depth 62 or the step 620 in relation to the thickness of the cladding element(s) 600 and thus the drip edge depth 630 can be greater than the thickness of the cladding element(s) 600 by other percentages. For example, the drip edge depth 630 can be greater than the thickness of the cladding element(s) 600 by 2%, 3%, 4%, 5%, 6%, 7%, 8%, 9%, 10%, 20%, 30%, 40%, 50%, 60%, or 70%, or any value or range therebetween, or any range bounded by any combination of these values, although values outside these ranges can be used in some cases so long as the cladding element(s) 600 have sufficient strength capacity, for example, to resist flexural bending and/or shear forces.

This enhanced drip edge depth 630 also creates an enhanced shadow 632 when the assembly 700 is lit from a generally upward angle, creating an enhanced shadow line 634 visible on the recessed portion 622 of the underlying cladding element 600. Thus, as discussed above, this overlap of the cladding element 600 and the step 620 advantageously creates a thicker, longer, and/or deeper shadow line, while also requiring less overall raw material utilization, and less weight than would be required to manufacture cladding articles 600 having a thickness equal to the enhanced drip edge depth 630. As can be seen from FIG. 7, one or more cladding elements 600 can thus be combined and overlapped to create a finished product (e.g., a finished exterior wall) that advantageously approximates the desirable aesthetic and functional attributes of natural tapered wood shingles.

Figure 8:
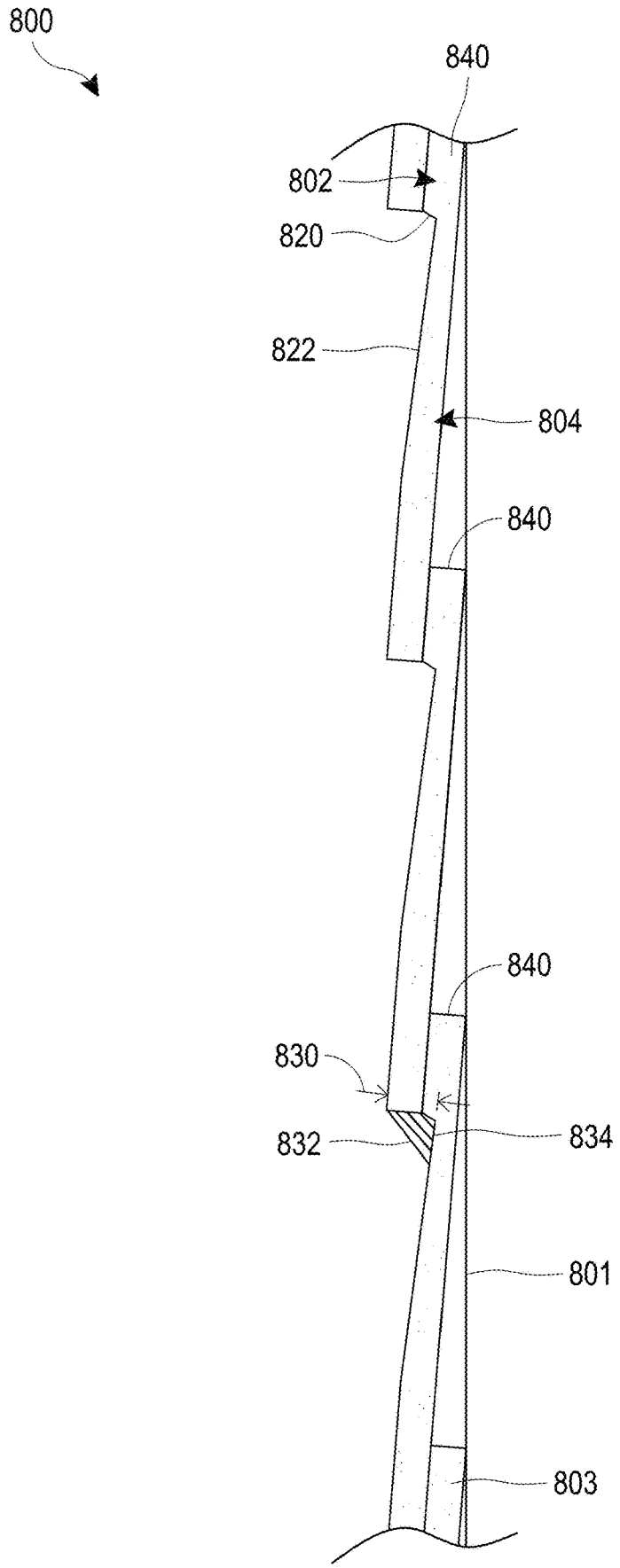
FIG. 8 illustrates multiple siding elements with stepped coves when installed.

FIG. 8 illustrates an assembly 800 of lap siding elements 840 in an installed configuration, wherein multiple lap siding elements 840 are installed in an overlapping arrangement on a building substrate 801. The building substrate 801 can include one or more of structural members such as studs, a sheathing such as plywood or oriented strand board, a building wrap or weather resistant barrier, or other substrate component. As shown, the lap siding elements 840 are aligned such that a lower section 804 of each overlapping lap siding element 840 overlies an upper section 802 of the underlying lap siding element 840, and the lower section 804 of the overlapping lap siding element 840 terminates proximate a step 820 of the underlying lap siding element 840. A starter strip 803 can underlay a lower portion of a first (e.g., lowest) course of lap siding, with second and third courses of lap siding depicted above. Accordingly, the thickness of the lower section 804 of the overlying lap siding element 840 combines with the depth of the step 820 of the underlying lap siding element 840 to form a larger effective drip edge, having an enhanced drip edge depth 830 greater than the maximum thickness of the lap siding elements 840. This enhanced drip edge depth 830 also creates an enhanced shadow 832 when the assembly 800 is lit from a generally upward angle, creating an enhanced shadow line 834 visible on a recessed portion 822 of the underlying lap siding element 840. Thus, as discussed above, this overlap of the lap siding element 840 and the step 820 advantageously creates a thicker, longer, and/or deeper shadow line, while also requiring less overall raw material utilization, and less weight than would be required to manufacture lap siding articles 840 having a thickness equal to the enhanced drip edge depth 830. As can be seen from FIG. 8, one or more lap siding elements 840 can thus be combined and overlapped to create a finished product (e.g., a finished exterior wall) that advantageously approximates the desirable aesthetic and functional attributes of natural tapered wood lap siding.

It should be recognized that the features, characteristics, dimensions, and properties discussed above with reference to FIGS. 7 and 8 are applicable (as discussed above) to any type of product that can be lapped. Thus, FIGS. 7 and 8 can show the advantages of, for example, the step and/or recessed cove features of this disclosure and how they can be utilized by other types of products that can be lapped.

Figure 9:
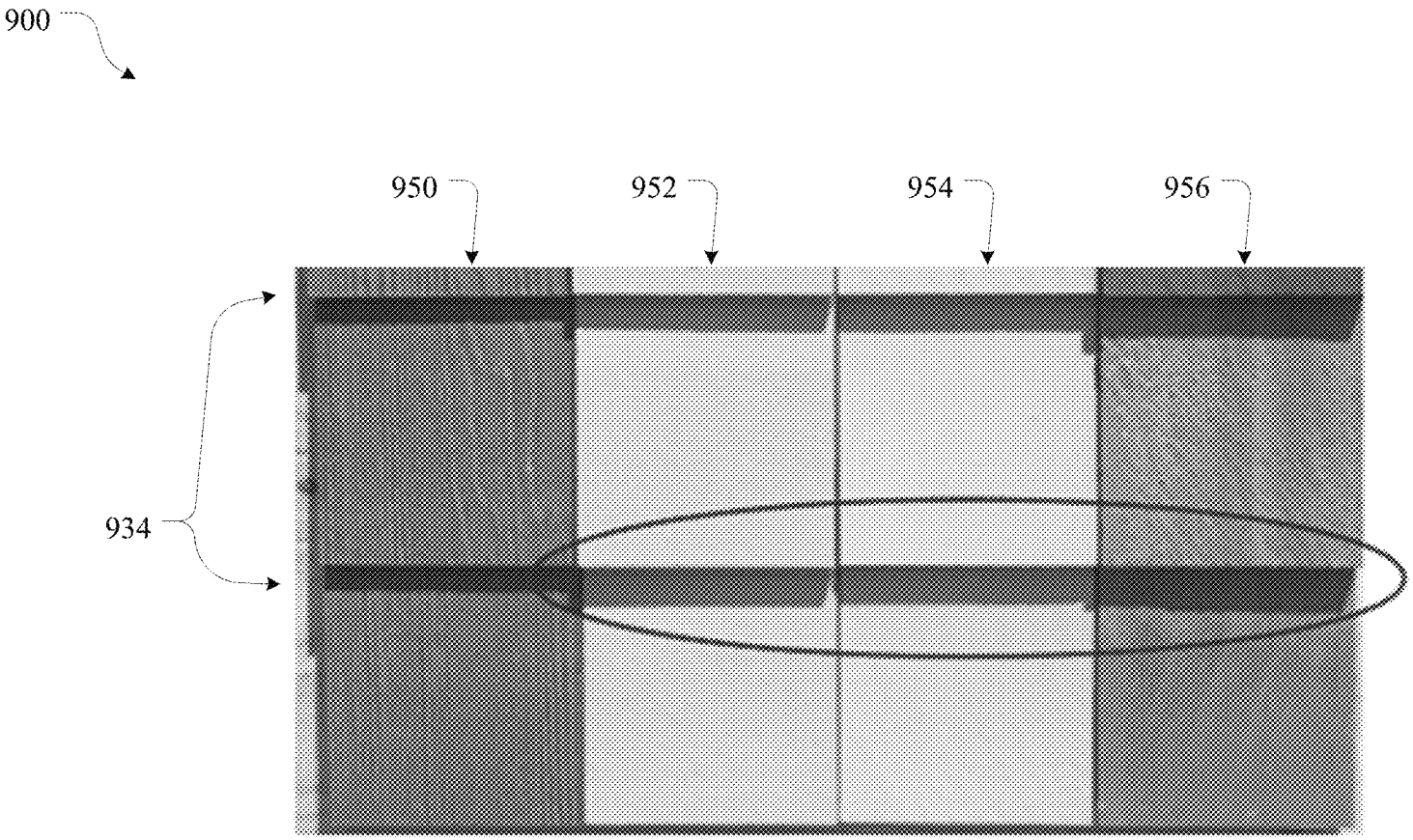
FIG. 9 illustrates shingle and/or siding elements of this disclosure with drip edges and shadow lines shown as compared to drip edges and shadow lines from two natural wood shingle and/or siding elements.

FIG. 9 illustrates the enhanced shadow lines for siding and/or cladding elements of the present disclosure as compared to drip edges and shadow lines of natural wood siding and/or shingle members. The shadow lines 934 created by the different cladding elements of FIG. 9 are displayed side by side for comparison. Column 950 comprises fiber cement shingle having a thickness of 0.25" (0.635 cm), with a square profile without the novel stepped cove features described herein. Column 952 comprises fiber cement shingle having a thickness of 0.3125" (0.79375 cm), including a stepped cove with a depth of 0.0625" (0.15875 cm), producing a total effective drip edge of 0.375" (0.9525 cm). Column 954 comprises natural eastern white cedar having a typical tapered profile with a drip edge of 0.375" (0.9525 cm). Column 956 comprises western red cedar having a typical tapered profile with a drip edge of 0.4375" (1.11125 cm). The shadow line 934 at column 950 (standard cementitious cladding) is substantially narrower than the shadow line 934 at the remaining columns, while the shadow line 934 at column 952 (cladding with a stepped cove feature) is substantially the same thickness as the shadow line 934 at column 954 (0.375" tapered natural white cedar). The direct comparison in FIG. 9 of the shadow lines 934 thus illustrates how the stepped cove features described herein can produce an enhanced shadow line approximating a tapered natural wood product without requiring significant additional materials or weight.

Table 1 below demonstrates the substantial weight and raw material savings that can be realized using the innovative stepped cove profiles described herein. Table 1 includes example base substrate thicknesses and step depths, along with the net drip edge thickness created by each combination of base substrate thickness and step depth. Additionally, Table 1 demonstrates the weight and raw material savings resulting from the stepped cove fiber cement shingle and/or siding elements disclosed herein. The weight and raw material savings for each thickness and depth combination was calculated by comparison to the amount of weight and raw material that would have been required to make a standard rectangular profile fiber cement shingle having the full net drip edge thickness along its entire surface area.

TABLE 1

Weight and Raw Material Savings

| Base Substrate Thickness (Inch) | Stepped Cove Depth (Inch) | Net Drip Edge Thickness (Inch) | Weight and Raw Material Savings (%) |
|---|---|---|---|
| 1/4 | 0 | 1/4 | 0 |
| 1/4 | 1/16 | 5/16 | 20 (vs. 5/16 inch) |
| 1/4 | 1/8 | 3/8 | 33 (vs. 3/8 inch) |
| 5/16 | 1/16 | 3/8 | 16.7 (vs. 3/8 inch) |
| 5/16 | 1/8 | 7/16 | 28.6 (vs. 7/16 inch) |
| 5/8 | 1/16 | 11/16 | 9.1 (vs. 11/16 inch) |
| 5/8 | 1/8 | 3/4 | 16.7 (vs. 3/4 inch) |

Cementitious Article Coatings

The color of the coatings provided herein may be described using CIELAB, a three-coordinate color space specified by the International Commission on Illumination. The three coordinates of CIELAB represent the lightness L of the color (L=0 yields black and L=100 indicates diffuse white; specular white may be higher), its position a between red/magenta and green (a ranges from −128 to +128, with negative values indicating green and positive values indicating magenta), and its position b between yellow and blue (b ranges from −128 to +128, with negative values indicating blue and positive values indicating yellow).

Alternatively, the color of the coatings described herein may be described using the RGB color model. A color in the RGB color model is described by indicating how much of each of the red, green, and blue is included. The color is expressed as an RGB triplet (R,G,B), each component of which can vary from zero to 255. An RGB triplet of (0,0,0) indicates black; an RGB triplet of (255, 255, 255) indicates the brightest representable white.

As described above, the overall coating system comprises a combination of the new cementitious article patterns with specifically designed basecoat and topcoat paint systems applied to them. In some embodiments, the waterborne coating system application process comprises: (1) application of a two-part waterborne epoxy sealer; (2) application of one or more solid basecoats; and (3) application of one or more topcoats. The basecoat and topcoat colors can be selected to simulate the appearance of natural wood including eastern grey cedar and western red cedar. In some embodiments, the topcoat is transparent or semi-transparent. In some embodiments, the topcoat is non-transparent.

In order to produce the natural look of cedar wood on a fiber cement article, both the texture pattern and the coating color system can be implemented in combination to create fiber cement shingle that looks like cedar wood shingle. The basecoat colors described herein are designed to match the majority of the natural cedar wood colors. For example, in embodiments configured to approximate eastern grey cedar, the basecoats can be light grey, grey (e.g., a medium grey), or dark grey in color. In embodiments configured to approximate western red cedar, the basecoats can be light tan, medium tan, or dark brown in color. Two or more of these basecoats may be combined to produce additional color configurations. Various example color specifications of these basecoats will now be described.

In some embodiments, the light grey basecoat has an L value of from about 74.38 to about 78.38, an a value of from about −1.77 to about 2.23, and a b value ranging from about 0.51 to about 4.51. In some embodiments, the light grey basecoat has an L value of from about 75.38 to about 77.38, an a value of from about −0.77 to about 1.23, and a b value ranging from about 1.51 to about 3.51. In some embodiments, the light grey basecoat has an L value of from about 75.88 to about 76.88, an a value of from about −0.27 to about 0.73, and a b value ranging from about 2.01 to about 3.01. In some embodiments, the light grey basecoat has an L value of about 76.38, an a value of about 0.23, and a b value of about 2.51.

In some embodiments, the light grey basecoat has an RGB triplet of about (177.97 to 181.97, 175.17 to 179.17, 170.39 to 174.39). In some embodiments, the light grey basecoat has an RGB triplet of about (178.97 to 180.97, 176.17 to 178.17, 171.39 to 173.39). In some embodiments, the light grey basecoat has an RGB triplet of about (179.47 to 180.47, 176.67 to 177.67, 171.89 to 172.89). In some embodiments, the light grey basecoat has an RGB triplet of about (179.97, 177.17, 172.39).

In some embodiments, the grey basecoat has an L value of from about 70.38 to about 74.38, an a value of from about −1.77 to about 2.23, and a b value ranging from about 0.51 to about 4.51. In some embodiments, the grey basecoat has an L value of from about 71.38 to about 73.38, an a value of from about −0.77 to about 1.23, and a b value ranging from about 1.51 to about 3.51. In some embodiments, the grey basecoat has an L value of from about 71.88 to about 72.88, an a value of from about −0.27 to about 0.73, and a b value ranging from about 2.01 to about 3.01. In some embodiments, the grey basecoat has an L value of about 72.38, an a value of about 0.23, and a b value of about 2.51.

In some embodiments, the grey basecoat has an RGB triplet of about (167.67 to 171.67, 164.40 to 168.40, 160.22 to 164.22). In some embodiments, the grey basecoat has an RGB triplet of about (168.67 to 170.67, 165.40 to 167.40, 161.22 to 163.22). In some embodiments, the grey basecoat has an RGB triplet of about (169.17 to 170.17, 165.90 to 166.90, 161.72 to 162.72). In some embodiments, the grey basecoat has an RGB triplet of about (169.67, 166.40, 162.22).

In some embodiments, the dark grey basecoat has an L value of from about 66.38 to about 70.38, an a value of from about −1.77 to about 2.23, and a b value ranging from about 0.51 to about 4.51. In some embodiments, the dark grey basecoat has an L value of from about 67.38 to about 69.38, an a value of from about −0.77 to about 1.23, and a b value ranging from about 1.51 to about 3.51. In some embodiments, the dark grey basecoat has an L value of from about 67.88 to about 68.88, an a value of from about −0.27 to about 0.73, and a b value ranging from about 2.01 to about 3.01. In some embodiments, the dark grey basecoat has an L value of about 68.38, an a value of about 0.23, and a b value of about 2.51.

In some embodiments, the dark grey basecoat has an RGB triplet of about (188.89 to 192.89, 186.06 to 190.06, 181.78 to 185.78). In some embodiments, the dark grey basecoat has an RGB triplet of about (189.89 to 191.89, 187.06 to 189.06, 182.78 to 184.78). In some embodiments, the dark grey basecoat has an RGB triplet of about (190.39 to 191.39, 187.56 to 188.56, 183.28 to 184.28). In some embodiments, the dark grey basecoat has an RGB triplet of about (190.89, 188.06, 183.78).

In some embodiments, the light tan basecoat has an L value of from about 60.81 to about 64.81, an a value of from about 10.35 to about 14.35, and a b value ranging from about 21.79 to about 25.79. In some embodiments, the light tan basecoat has an L value of from about 61.81 to about 63.81, an a value of from about 11.35 to about 13.35, and a b value ranging from about 22.79 to about 24.79. In some embodiments, the light tan basecoat has an L value of from about 62.31 to about 63.31, an a value of from about 11.85 to about 12.85, and a b value ranging from about 23.29 to about 24.29. In some embodiments, the light tan basecoat has an L value of about 62.81, an a value of about 12.35, and a b value of about 23.79.

In some embodiments, the light tan basecoat has an RGB triplet of about (184.86 to 188.86, 141.07 to 145.07, 108.38 to 112.38). In some embodiments, the light tan basecoat has an RGB triplet of about (185.86 to 187.86, 142.07 to 144.07, 109.38 to 111.38). In some embodiments, the light tan basecoat has an RGB triplet of about (186.36 to 187.36, 142.57 to 143.57, 109.88 to 110.88). In some embodiments, the light tan basecoat has an RGB triplet of about (186.86, 143.07, 110.38).

In some embodiments, the medium tan basecoat has an L value of from about 53.99 to about 57.99, an a value of from about 9.78 to about 13.78, and a b value ranging from about 17.71 to about 21.71. In some embodiments, the medium tan basecoat has an L value of from about 54.99 to about 56.99, an a value of from about 10.78 to about 12.78, and a b value ranging from about 18.71 to about 20.71. In some embodiments, the medium tan basecoat has an L value of from about 55.49 to about 56.49, an a value of from about 11.28 to about 12.28, and a b value ranging from about 19.21 to about 20.21. In some embodiments, the medium tan basecoat has an L value of about 55.99, an a value of about 11.78, and a b value of about 19.71.

In some embodiments, the medium tan basecoat has an RGB triplet of about (163.27 to 167.27, 124.05 to 128.05, 98.62 to 102.62). In some embodiments, the medium tan basecoat has an RGB triplet of about (164.27 to 166.27, 125.05 to 127.05, 99.62 to 101.62). In some embodiments, the medium tan basecoat has an RGB triplet of about (164.77 to 165.77, 125.55 to 126.55, 100.12 to 101.12). In some embodiments, the medium tan basecoat has an RGB triplet of about (165.27, 126.05, 100.62).

In some embodiments, the dark brown basecoat has an L value of from about 42.97 to about 46.97, an a value of from about 9.00 to about 13.00, and a b value ranging from about 17.00 to about 21.00. In some embodiments, the dark brown basecoat has an L value of from about 43.97 to about 45.97, an a value of from about 10.00 to about 12.00, and a b value ranging from about 18.00 to about 20.00. In some embodiments, the dark brown basecoat has an L value of from about 42.47 to about 43.47, an a value of from about 10.50 to about 11.50, and a b value ranging from about 18.50 to about 19.50. In some embodiments, the dark brown basecoat has an L value of about 44.97, an a value of about 11.00, and a b value of about 19.00.

In some embodiments, the dark brown basecoat has an RGB triplet of about (129.92 to 133.92, 95.08 to 99.08, 71.43 to 75.43). In some embodiments, the dark brown basecoat has an RGB triplet of about (130.92 to 132.92, 96.08 to 98.08, 72.43 to 74.43). In some embodiments, the dark brown basecoat has an RGB triplet of about (1131.42 to 132.42, 96.58 to 97.58, 72.93 to 73.93). In some embodiments, the dark brown basecoat has an RGB triplet of about (131.92, 97.08, 73.43).

The viscosity rheology and solids of the topcoats are formulated so that they adhere preferentially to the valley areas (e.g., valley areas 108, 208, 308, 408 of FIGS. 1A-4D) of the texture patterns as opposed to the peak areas (e.g., peak areas 106, 206, 306, 406 of FIGS. 1A-4D). The contrast in appearance and color of the coating system combination results from the differences in dry film thickness (DFT), solids, color between the topcoat and topcoat, as well as the preferential adherence of the topcoat to the valley regions of the shingle. Without these differences between the basecoat and topcoat, the final product may have a monochromatic color appearance and would not resemble natural or stained cedar wood.

In some embodiments provided herein, the topcoats were designed to enhance the new texture patterns and give visual contrast to the basecoat colors. Each basecoat color and/or combination of basecoat colors may be paired with a specific color topcoat to create a desired cedar wood look. In some embodiments, the topcoat may be light grey, grey (e.g., a medium grey), dark grey, or dark brown in color.

In some embodiments, the light grey topcoat has an L value of from about 71.70 to about 75.70, an a value of from about −3.27 to about 0.73, and a b value ranging from about −0.54 to about 3.46. In some embodiments, the light grey topcoat has an L value of from about 72.70 to about 74.70, an a value of from about −2.27 to about −0.27, and a b value ranging from about 0.46 to about 2.46. In some embodiments, the light grey topcoat has an L value of from about 73.20 to about 74.20, an a value of from about −1.77 to about −0.77, and a b value ranging from about 0.96 to about 1.96. In some embodiments, the light grey topcoat has an L value of about 73.70, an a value of about −1.27, and a b value of about 1.46.

In some embodiments, the light grey topcoat has an RGB triplet of about (177.82 to 181.82, 179.69 to 183.69, 176.36 to 180.36). In some embodiments, the light grey topcoat has an RGB triplet of about (178.82 to 180.82, 180.69 to 182.69, 177.36 to 179.36). In some embodiments, the light grey topcoat has an RGB triplet of about (179.32 to 180.32, 181.19 to 182.19, 177.86 to 178.86). In some embodiments, the light grey topcoat has an RGB triplet of about (179.82, 181.69, 178.36).

In some embodiments, the grey topcoat has an L value of from about 64.35 to about 68.35, an a value of from about −2.78 to about 1.22, and a b value ranging from about −0.84 to about 3.16. In some embodiments, the grey topcoat has an L value of from about 65.35 to about 67.35, an a value of from about −1.78 to about 0.22, and a b value ranging from about 0.16 to about 2.16. In some embodiments, the grey topcoat has an L value of from about 65.85 to about 66.85, an a value of from about −1.28 to about −0.28, and a b value ranging from about 0.66 to about 1.66. In some embodiments, the grey topcoat has an L value of about 66.35, an a value of about −0.78, and a b value of about 1.16.

In some embodiments, the grey topcoat has an RGB triplet of about (158.76 to 162.76, 159.64 to 163.64, 157.19 to 161.19). In some embodiments, the grey topcoat has an RGB triplet of about (159.76 to 161.76, 160.64 to 162.64, 158.19 to 160.19). In some embodiments, the grey topcoat has an RGB triplet of about (160.26 to 161.26, 161.14 to 162.14, 158.69 to 159.69). In some embodiments, the grey topcoat has an RGB triplet of about (160.76, 161.64, 159.19).

In some embodiments, the dark grey topcoat has an L value of from about 60.34 to about 64.34, an a value of from about −2.77 to about 1.23, and a b value ranging from about −0.93 to about 3.07. In some embodiments, the dark grey topcoat has an L value of from about 61.34 to about 63.34, an a value of from about −1.77 to about 0.23, and a b value ranging from about 0.07 to about 2.07. In some embodiments, the dark grey topcoat has an L value of from about 61.84 to about 62.84, an a value of from about −1.27 to about −0.27, and a b value ranging from about 0.57 to about 1.57. In some embodiments, the dark grey topcoat has an L value of about 62.34, an a value of about −0.77, and a b value of about 1.07.

In some embodiments, the dark grey topcoat has an RGB triplet of about (148.10 to 152.10, 149.04 to 153.04, 146.77 to 150.77). In some embodiments, the dark grey topcoat has an RGB triplet of about (149.10 to 151.10, 150.04 to 152.04, 147.77 to 149.77). In some embodiments, the dark grey topcoat has an RGB triplet of about (149.60 to 150.60, 150.54 to 151.5, 148.27 to 149.27). In some embodiments, the dark grey topcoat has an RGB triplet of about (150.10, 151.04, 148.77).

In some embodiments, the dark grey topcoat has an L value of from about 38.39 to about 42.39, an a value of from about 5.65 to about 9.65, and a b value ranging from about 10.51 to about 14.51. In some embodiments, the dark grey topcoat has an L value of from about 39.39 to about 41.39, an a value of from about 6.65 to about 8.65, and a b value ranging from about 11.51 to about 13.51. In some embodiments, the dark grey topcoat has an L value of from about 39.89 to about 40.89, an a value of from about 7.15 to about 8.15, and a b value ranging from about 12.01 to about 13.01. In some embodiments, the dark grey topcoat has an L value of about 40.39, an a value of about 7.65, and a b value of about 12.51.

In some embodiments, the dark grey topcoat has an RGB triplet of about (112.56 to 116.56, 88.27 to 92.27, 73.18 to 77.18). In some embodiments, the dark grey topcoat has an RGB triplet of about (113.56 to 115.56, 89.27 to 91.27, 74.18 to 76.18). In some embodiments, the dark grey topcoat has an RGB triplet of about (114.06 to 115.06, 89.77 to 90.77, 74.68 to 75.68). In some embodiments, the dark grey topcoat has an RGB triplet of about (114.56, 90.27, 75.18).

In some embodiments, the dark brown topcoat has an L value of from about 46.44 to about 50.44, an a value of from about 19.20 to about 23.20, and a b value ranging from about 26.01 to about 30.01. In some embodiments, the dark brown topcoat has an L value of from about 47.44 to about 49.44, an a value of from about 20.20 to about 22.20, and a b value ranging from about 27.01 to about 29.01. In some embodiments, the dark brown topcoat has an L value of from about 47.97 to about 48.94, an a value of from about 20.70 to about 21.70, and a b value ranging from about 27.51 to about 28.51. In some embodiments, the dark brown topcoat has an L value of about 48.44, an a value of about 21.20, and a b value of about 28.01.

In some embodiments, the dark brown topcoat has an RGB triplet of about (158.67 to 162.67, 98.27 to 102.27, 66.61 to 70.61). In some embodiments, the dark brown topcoat has an RGB triplet of about (159.67 to 161.67, 99.27 to 101.27, 67.61 to 69.61). In some embodiments, the dark brown topcoat has an RGB triplet of about (160.17 to 161.17, 99.77 to 100.77, 68.11 to 69.11). In some embodiments, the dark brown topcoat has an RGB triplet of about (160.67, 100.27, 68.61).

In some embodiments, the dark brown topcoat has an L value of from about 44.42 to about 48.42, an a value of from about 16.87 to about 20.87, and a b value ranging from about 23.42 to about 27.42. In some embodiments, the dark brown topcoat has an L value of from about 45.42 to about 47.42, an a value of from about 17.87 to about 19.87, and a b value ranging from about 24.42 to about 26.42. In some embodiments, the dark brown topcoat has an L value of from about 45.92 to about 46.92, an a value of from about 18.37 to about 19.37, and a b value ranging from about 24.92 to about 25.92. In some embodiments, the dark brown topcoat has an L value of about 46.42, an a value of about 18.87, and a b value of about 25.42.

In some embodiments, the dark brown topcoat has an RGB triplet of about (149.10 to 153.10, 95.08 to 99.08, 66.23 to 70.23). In some embodiments, the dark brown topcoat has an RGB triplet of about (150.10 to 152.10, 96.08 to 98.08, 67.23 to 69.23). In some embodiments, the dark brown topcoat has an RGB triplet of about (150.60 to 151.60, 96.58 to 98.58, 67.73 to 68.73). In some embodiments, the dark brown topcoat has an RGB triplet of about (151.10, 97.08, 68.23).

Dry film thickness (DFT) is the thickness of a coating as measured above the substrate. This can consist of a single layer or multiple layers. DFT is measured for cured coatings (after the coating dries). Thickness of a coating depends on the application and type of process employed. The DFT is often represented in mil (i.e., 0.001 inch).

In some embodiments provided herein, the DFT of the basecoat is from 0.1 to 2.0 mil. In some embodiments, the DFT of the basecoat is from 0.5 to 2.0 mil. In some embodiments, the DFT of the basecoat is from 1.0 to 2.0 mil. In some embodiments, the DFT of the basecoat is from 1.5 to 1.9 mil. In some preferred embodiments, the DFT of the basecoat is from 1.7 to 1.8 mil. In some embodiments provided herein, the DFT of the topcoat is from 0.1 to 2.0 mil. In some embodiments, the DFT of the topcoat is from 0.5 to 1.0 mil. In some embodiments, the DFT of the topcoat is from 0.6 to 0.9 mil. In some preferred embodiments, the DFT of the topcoat is from 0.7 to 0.8 mil.

In some embodiments, the DFT of the basecoat is from 1.0 to 2.0 mil and the DFT of the topcoat is from 0.1 to 2.0 mil. In some embodiments, the DFT of the basecoat is from 1.5 to 1.9 mil and the DFT of the topcoat is from 0.5 to 1.0 mil. In some embodiments, the DFT of the basecoat is from 1.7 to 1.8 mil and the DFT of the topcoat is from 0.7 to 0.8 mil. In some embodiments, the DFT of the topcoat is smaller than the DFT of the basecoat. In some embodiments, the DFT of the topcoat is a certain percentage of the DFT of the basecoat, for example, 20%, 30%, 40%, 50%, 60%, or 70% of the DFT of the basecoat. In some embodiments, the variation between the DFT of the topcoat relative to the DFT of the basecoat can help enhance an appearance of a manufactured building article better resemble natural wood.

The weight percent non-volatile material (NVM) is used in the coatings industry to describe the portion of a coating that remains as part of the cured film. In some embodiments provided herein, the basecoat has an NMV from 40 to 60 percent. In some embodiments provided herein, the basecoat has an NMV from 50 to 60 percent. In some embodiments provided herein, the top has an NMV from 30 to 70 percent. In some embodiments provided herein, the topcoat has an NMV from 30 to 50 percent. In some embodiments provided herein, the topcoat has an NMV from 35 to 45 percent.

In some embodiments, the topcoat may comprise one or more UV absorbers (UVA). The UV absorber functions to absorb UV rays from the sunlight and dissipate them through the surface or the coating. In one embodiment, a UV absorber comprises 2-hydroxyphenyl-benzophenones, 2-(2-hydroxyphenyl)benzotriazole or 2-hydroxyphenyl-s-triazine, or a derivative thereof, however it is understood that any suitable UV absorber known to a person skilled in the art can also be used.

In some embodiments, the topcoat may comprise one or more Hindered Amine Light Stabilizer (HALS) additives. The HALS functions to neutralize photochemically produced free-radicals in the coating resin. In one embodiment, the at least one HALS can comprise di or oligo-functional HALS based on tetramethylpiperidine derivatives, however, it is understood that any suitable HALS known to a person skilled in the art can also be used.

An advantage of adding the at least one UV absorber and/or the at least one HALS is that each enhances the performance of a coating system of the present disclosure over time. In particular the at least one UV absorber and/or the at least one HALS prevent fade and enhance color retention while improving chalk resistance.

A system for installation of one or more building articles on a building substrate typically includes a relatively large number of building articles (for example, shingles). For example, a system for installation of one or more shingles on a building substrate can include tens or hundreds of shingles or more, and the one or more shingles can have a variety in colors that replicate the natural range of colors found in a particular type of wood. For example, in some embodiments, the shingle system replicates the natural range of colors found in eastern grey cedar or western red cedar.

As discussed above, the color of a shingle can be described using a CIELAB system and/or an RGB color model. As also discussed herein, a shingle can have one or more basecoats and one or more topcoats. The color of a shingle can be described using a color of one or more of the basecoats, one or more of the topcoats, and/or a combination of one or more basecoats and/or one or more topcoats. For example, a shingle can have a basecoat having a color value that can be described and/or classified using the CIELAB system (and/or an RGB color model) and/or a topcoat having a color value that can be described and/or classified using the CIELAB system (and/or an RGB color model). Further, a shingle having one or more basecoats and one or more topcoats can have a CIELAB or RGB color that encompasses the individual CIELAB or RGB color values of each of the one or more basecoats and one or more topcoats.

The difference in color between shingles in a system or set can be described by the difference in the total color value (dE) between each shingle. The difference in color between shingles can be described as the difference between the CIELAB or RGB basecoat color values, the difference between the CIELAB or RGB topcoat color values, and/or the difference between an overall CIELAB or RGB color value for shingles, each of the overall shingle color values incorporating and/or combining the CIELAB or RGB basecoat and topcoat color values. For example, the difference in color between shingles can be described as a difference between the CIELAB or RGB values for the basecoats of the shingles. As another example, the difference in color between shingles can be described as a difference between the CIELAB or RGB values for the topcoats of the shingles. As another example, where a first shingle has a basecoat having a CIELAB or RGB value, a topcoat having a CIELAB or RGB value, and a combined CIELAB or RGB value which encompasses both, and where a second shingle has a basecoat having a CIELAB or RGB value, a topcoat having a CIELAB or RGB value, and a combined CIELAB or RGB value which encompasses both, a difference in color between the first shingle and the second shingle can be described as a difference (dE) between the combined CIELAB or RGB values for the first and second shingle.

The dE value between any two shingles can be determined by the formula $dE=[(L_2-L_1)^2+(a_2-a_1)^2+(b_2-b_1)^2]^{1/2}$ for the CIELAB system. The dE value between any two shingles can also be determined in a similar manner for the RGB system by the formula $dE=[(R_2-R_1)^2+(G_2-G_1)^2+(B_2-B_1)^2]^{1/2}$. These formulas can be used to describe the difference in color between basecoats in different shingles and/or topcoats in different shingles. Additionally, where two shingles each include one or more basecoats and one or more topcoats and a combined color value which encompasses both of the one or more basecoats and the one or more topcoats, these formulas can be used to describe the difference between these combined color values.

Generally, the colors in a set of shingles may be described by the minimum difference (dE) between adjacent shades, as well as by the difference (dE) between the most different shades in the set. In some embodiments, a minimum difference between the color values (dE) of any two shingles in a shingle system/set is from about 0.05 to about 10, for example, from about 0.2 to about 6, from about 0.1 to about 10, from about 0.2 to about 10, from about 0.3 to about 10, from about 0.4 to about 10, from about 0.5 to about 10, from about 0.6 to about 10, from about 0.7 to about 10, from about 0.8 to about 10, from about 0.9 to about 10, from about 1 to about 10, from about 2 to about 10, from about 3 to about 10, from about 4 to about 10, from about 5 to about 10, from about 6 to about 10, from about 7 to about 10, from about 8 to about 10, from about 9 to about 10, from about 2 to about 9, from about 3 to about 8, from about 4 to about 7, from about 5 to about 6, from about 0.05 to about 9, from about 0.05 to about 8, from about 0.05 to about 7, from about 0.05 to about 6, from about 0.05 to about 5, from about 0.05 to about 4, from about 0.05 to about 3, from about 0.05 to about 2, from about 0.05 to about 1, or from about 0.05 to about 0.5. In some embodiments, the dE between a shingle with a lowest color value and a shingle with a highest color value in a shingle system or set is from about 0.05 to about 10, for example, from about 0.2 to about 6, from about 0.1 to about 10, from about 0.2 to about 10, from about 0.3 to about 10, from about 0.4 to about 10, from about 0.5 to about 10, from about 0.6 to about 10, from about 0.7 to about 10, from about 0.8 to about 10, from about 0.9 to about 10, from about 1 to about 10, from about 2 to about 10, from about 3 to about 10, from about 4 to about 10, from about 5 to about 10, from about 6 to about 10, from about 7 to about 10, from about 8 to about 10, from about 9 to about 10, from about 2 to about 9, from about 3 to about 8, from about 4 to about 7, from about 5 to about 6, from about 0.05 to about 9, from about 0.05 to about 8, from about 0.05 to about 7, from about 0.05 to about 6, from about 0.05 to about 5, from about 0.05 to about 4, from about 0.5 to about 3, from about 0.05 to about 2, from about 0.05 to about 1, or from about 0.05 to about 0.5.

In some embodiments, a maximum difference dE between any two shingles in a set of shingles for installation on a single building substrate is 10, 9, 8, 7, 6, 5, 4, 3, 2, or 1, for example, and/or any two adjacent shingles can have a minimum dE of 0.05, 0.1, 0.2, 0.3, 0.4, 0.5, 0.6, 0.7, 0.8, 0.9, 1, 2, 3, or 4, for example. In some embodiments, there may be 4 different shades, for example, having color values E of n, n+2, n+4, and n+6. Moreover, the different shades may be applied randomly to the different shingle textures so as to provide an appearance of a large amount of variation between shingles as would be found, for example, in natural cedar shingle.

In one example, a set of shingles for installation on a single building substrate may have a minimum dE of 2 between adjacent shades, and may have a total overall dE of 6 between the lowest and highest color values in the set. In this example embodiment, there may be 4 different shades, for example, having color values E of n, n+2, n+4, and n+6. Moreover, the different shades may be applied randomly to the different building article textures so as to provide an appearance of a large amount of variation between shingles as would be found, for example, in natural cedar shingle.

One of the reasons it is difficult to replicate the appearance of natural wood with manufactured building articles (for example shingles) is because the human eye can recognize repetitive patterns relatively well. Keeping the differences between color values of building articles in a system or set within values or ranges such as those described above can advantageously create a natural appearance of wood on building articles comprising non-wood material (for example, fiber cement), as discussed elsewhere herein.

As discussed above, the shingles disclosed herein can have a basecoat and a topcoat. The basecoat can have a color value, using the CIELAB system, having an L value, an a value, and a b value. Similarly, the topcoat can have a color value, using the CIELAB system, having an L value, an a value, and a b value. The dE value between the basecoat and the topcoat of a shingle can be determined by the formula $dE=[(L_2-L_1)^2+(a_2-a_1)^2+(b_2-b_1)^2]^{1/2}$ for the CIELAB system. The dE value between the basecoat and the topcoat of a shingle can be similarly determined where the basecoats and topcoat have RGB values by the formula $dE=[(R_2-R_1)^2+(G_2-G_1)^2+(B_2-B_1)^2]^{1/2}$. In some embodiments, the dE value between the basecoat and the topcoat can be selected so as to enhance an appearance of a manufactured shingle so as to resemble natural or stained cedar wood. For example, as shown in Table 2 below, a shingle can have a basecoat having a light grey color having an L value of 76.38, an a value of 0.23, and a b value of 2.51 and can have a topcoat having a light grey color having an L value of 73.70, an a value of −1.27, and a b value of 1.46. The difference dE between the basecoat and the topcoat in this example is 3.25. Similarly, the differences dE between the colors of basecoats and topcoats in other shingles in Table 2 and Table 4 can be determined. In some embodiments, the dE between a basecoat and a topcoat in a shingle can be between 3 and 7. In some embodiments, dE between a basecoat and a topcoat in a shingle can be at least 3 but no greater than 7. In some embodiments, the dE between a basecoat and a topcoat in a shingle can be between 8 and 18. In some embodiments, dE between a basecoat and a topcoat in a shingle can be at least 8 but no greater than 18. In some embodiments, the dE between a basecoat and a topcoat in a shingle can be between 1 and 3, between 3 and 20, between 3 and 15, or between 3 and 10.

In some embodiments, a manufactured shingle (for example, a fiber cement shingle) can have a topcoat having a DFT that is smaller than a DFT of the basecoat. For example, as shown in Tables 1 and 3, the topcoat can have a DFT of between 0.70 and 0.80 and the basecoat can have a DFT of between 1.70 and 1.80. As discussed above, the DFT of the topcoat can be a certain percentage of the DFT of the basecoat in some embodiments.

In some embodiments, a manufactured shingle (for example, a fiber cement shingle) can have a topcoat having a weight percent non-volatile material (NVM) that is smaller than a weight percent non-volatile material (NVM) of the basecoat. For example, the topcoat can have an NVM between 40% and 50% and the basecoat can have an NVM between 50% and 60%. In some embodiments, the basecoat can have a NVM that is greater than an NVM of the topcoat by 5%, 10%, 20%, 30%, 40%, or 50%. In some embodiments, the basecoat can have a NVM that is greater than an NVM of the topcoat by at least 5%, at least 10%, at least 20%, at least 30%.

Manufacturing a shingle with different topcoat/basecoat colors, DFT values, and/or NVM values can help the manufactured shingle have a more natural wood appearance as opposed to a monochromatic appearance.

EXAMPLES

Example 1: Basecoats and Topcoats for Eastern Gray Cedar Two-Tone Coating Specifications Example basecoat and topcoat specifications for an Eastern grey cedar two-tone coating process are presented below in Table 1. Each numbered topcoat was designed specifically for each numbered basecoat so that the basecoat/topcoat combinations created a stained look grey cedar appearance on the fiber cement shingle.

TABLE 1

Eastern cedar stain two-tone coating system specifications

| | Color | NVM % | WPG | pH | DFT (mil) |
|---|---|---|---|---|---|
| Basecoat | | | | | |
| 1 | Light grey | 55.8 | 10.51 | 8.8 | 1.70-1.80 |
| 2 | grey | 55.68 | 10.47 | 8.8 | 1.70-1.80 |
| 3 | Dark grey | 55.57 | 10.44 | 8.8 | 1.70-1.80 |
| Topcoat | | | | | |
| 1 | Light grey | 40.8 | 8.83 | 8.5-9.5 | 0.70-0.80 |
| 2 | grey | 40.8 | 8.83 | 8.5-9.5 | 0.70-0.80 |
| 3 | Dark grey | 40.8 | 8.83 | 8.5-9.5 | 0.70-0.80 |

In order to achieve the desired appearance of eastern grey stained cedar, the basecoat and topcoat color ranges are designed to have the CIELAB and RGB values provided in Table 2 below. The color range values are narrow so that the desired distinction between basecoat and topcoat combinations can be maintained once applied.

TABLE 2

Eastern cedar stain look two-tone color values. Maintaining the CIELAB color values within L +/− 0.50, a +/− 0.10 and b +/− 0.25 for the basecoat colors, and L +/− 0.50, a +/− 0.25 and b +/− 0.25 for the topcoat colors can help ensure that the appropriate overall color is achieved.

| | | CIELAB values | | | RGB Values | | |
|---|---|---|---|---|---|---|---|
| | Color | L | a | b | R | G | B |
| Basecoat | | | | | | | |
| 1 | Light grey | 76.38 | 0.23 | 2.51 | 179.97 | 177.17 | 172.39 |
| 2 | Grey | 72.38 | 0.23 | 2.51 | 169.67 | 161.64 | 162.22 |
| 3 | Dark grey | 68.38 | 0.23 | 2.51 | 190.89 | 188.06 | 183.78 |
| Topcoat | | | | | | | |
| 1 | Light grey | 73.70 | −1.27 | 1.46 | 179.82 | 181.69 | 178.36 |
| 2 | Grey | 66.35 | −0.78 | 1.16 | 160.76 | 166.40 | 159.19 |
| 3 | Dark grey | 62.34 | −0.77 | 1.07 | 150.10 | 151.04 | 148.77 |

Example 2: Basecoats and Topcoats for Western Red Cedar Two-Tone Coating Specifications The basecoat and topcoat specifications for the Western red cedar two-tone are presented below in Table 3. The three wood color basecoat for western red cedar were designed to match the most prevalent colors that occur naturally in red cedar. The topcoats were designed specifically for each wood color basecoat so that the basecoat/topcoat combinations create a stained look red cedar appearance on the fiber cement shingle. The impact of the new texture patterns aids significantly in creating a sawn cut wood appearance, and both the new shingle pattern and the new coating system colors are required to achieve the overall natural wood appearance.

TABLE 3

Western red cedar stain look two-tone coating system stain look two-tone coating system.

| | Color | NVM % | WPG | pH | DFT (mil) |
|---|---|---|---|---|---|
| Basecoat | | | | | |
| 1 | Light tan | 54.28 | 10.24 | 8.8 | 1.70-1.80 |
| 2 | Medium tan | 53.85 | 10.13 | 8.8 | 1.70-1.80 |
| 3 | Dark brown | 52.98 | 9.96 | 8.8 | 1.70-1.80 |
| Topcoat | | | | | |
| 1 | Dark brown | 46.90 | 9.90 | 8.5-9.5 | 0.70-0.80 |
| 2 | Dark brown | 46.90 | 9.90 | 8.5-9.5 | 0.70-0.80 |
| 3 | Dark grey | 40.80 | 8.83 | 8.5-9.5 | 0.70-0.80 |

In order to achieve the desired appearance of western red stained cedar, the basecoat and topcoat color ranges are designed to have the CIELAB and RGB values provided in Table 4 below. The color range values are narrow so that the desired distinction between basecoat and topcoat combinations can be maintained once applied.

TABLE 4

Western red cedar stain look two-tone coating system. Maintaining the CIELAB color values within L +/− 0.50, a +/− 0.50 and b +/− 0.50 for the basecoat colors, and L +/− 0.50, a +/− 0.50 and b +/− 0.50 for the topcoat colors can help ensure that the appropriate overall color is achieved.

| | | CIELAB values | | | RGB Values | | |
|---|---|---|---|---|---|---|---|
| | Color | L | a | b | R | G | B |
| Basecoat | | | | | | | |
| 1 | Light tan | 62.81 | 12.35 | 23.79 | 186.86 | 143.07 | 110.38 |
| 2 | Medium tan | 55.99 | 11.78 | 19.71 | 165.27 | 126.05 | 100.62 |
| 3 | Dark brown | 44.97 | 11.00 | 19.00 | 131.92 | 97.08 | 73.43 |
| Topcoat | | | | | | | |
| 1 | Dark brown | 48.44 | 21.20 | 28.01 | 160.67 | 100.27 | 68.61 |
| 2 | Dark brown | 46.42 | 18.87 | 25.42 | 151.10 | 97.08 | 68.23 |
| 3 | Dark grey | 40.39 | 7.65 | 12.51 | 114.56 | 90.27 | 75.18 |

Example 3: Eastern Grey Cedar Shingle System

The shingle systems presented below in Tables 5 and 6 were developed to replicate the color variation found in natural eastern grey cedar. The shingles below have varying L, a, and b values. Values for dE are referenced to shingle number 1 in each of the two systems provided.

TABLE 5

Eastern gray cedar shingle system.

| No. | Basecoat 1 | Basecoat 2 | Topcoat | L | a | b | dL | da | db | dE |
|---|---|---|---|---|---|---|---|---|---|---|
| 1 | Light grey | Light grey | Light grey | 70.13 | 0.49 | 2.66 | — | — | — | — |
| 2 | Light grey | Medium grey | Light grey | 66.66 | 0.54 | 2.78 | −3.47 | 0.05 | 0.12 | 3.47 |
| 3 | Light grey | Light grey | Medium grey | 65.06 | 0.78 | 2.35 | −5.04 | 0.29 | −0.31 | 5.06 |
| 4 | Light grey | Medium grey | Medium grey | 63.10 | 0.72 | 2.40 | −7.03 | 0.23 | −0.26 | 7.04 |

TABLE 6

Eastern gray cedar shingle system.

| No. | Basecoat 1 | Basecoat 2 | Topcoat | L | a | b | dL | da | db | dE |
|---|---|---|---|---|---|---|---|---|---|---|
| 1 | Light grey | Light grey | Light grey | 63.65 | 0.91 | 2.73 | — | — | — | — |
| 2 | Light grey | Medium grey | Light grey | 62.28 | 1.03 | 2.68 | −1.37 | 0.12 | −0.05 | 1.38 |
| 3 | Light grey | Light grey | Medium grey | 63.10 | 1.11 | 2.48 | −0.55 | 0.20 | −0.25 | 0.64 |
| 4 | Light grey | Medium grey | Medium grey | 60.18 | 1.30 | 2.46 | −3.47 | 0.39 | −0.27 | 3.50 |

The foregoing description of the preferred embodiments of the present disclosure has shown, described and pointed out the fundamental novel features of coating systems provided herein. The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

What is claimed is:

1. A cladding shingle system configured to secure to an exterior of a building structure, the cladding shingle system comprising:

a first cladding shingle and a second cladding shingle, each of the first and second cladding shingles comprising a fiber cement substrate and further comprising:

a top edge and a bottom edge opposite the top edge;

a substantially planar rear face extending uninterruptedly between the top edge and the bottom edge; and a front face opposite the rear face and extending between the top edge and the bottom edge, the front face having a wood grain texture pattern imprinted on a portion thereof, the front face further comprising:

an upper section spaced from the rear face by a first thickness, the upper section being substantially parallel to the rear face, the upper section extending from the top edge;

a lower section spaced from the rear face by the first thickness, the lower section being substantially parallel to the rear face, the lower section extending from the bottom edge;

a recessed portion having a first end adjacent the lower section and a second end opposite the first end, the first end spaced from the rear face by a first distance and the second end spaced from the rear face by a second distance, wherein the recessed portion is disposed at a first angle relative to the lower section such that the first distance is greater than the second distance, the second distance defining a minimum thickness of each of the first and second cladding shingles; and a step contiguous with the upper section and the second end of the recessed portion, the step disposed at a second angle relative to the upper section, wherein the second angle of the step is greater than the first angle of the recessed portion;

wherein the wood grain texture pattern covers at least the lower section and the recessed portion of the front face;

wherein, in an installed configuration on the exterior of the building structure, at least a portion of the rear face of the first cladding shingle overlaps substantially all of the upper section of the front face of the second cladding shingle and the bottom edge of the first cladding shingle and the step of the second cladding shingle define a drip edge having a drip edge depth, wherein the drip edge depth is greater than the first thickness.

2. The cladding shingle system of claim 1, wherein each of the wood grain texture patterns of the front faces of the first and second cladding shingles comprises a three-dimensional wood grain pattern comprising one of circular saw marks, raised fibers, edge grain, and cathedrals, and wherein the three-dimensional wood grain pattern of the first and second cladding shingles are different from each other.

3. The cladding shingle system of claim 1, wherein the first angle of the recessed portion is between 0 degrees and 20 degrees.

4. The cladding shingle system of claim 1, wherein the second angle of the step is between 30 degrees and 90 degrees.

5. The cladding shingle system of claim 1, wherein the step comprises a shorter length than the recessed portion.

6. The cladding shingle system of claim 1, wherein the drip edge depth is greater than the first thickness by at least 5%.

7. A cladding shingle for a building structure, the cladding shingle configured to be installed with a plurality of additional cladding shingles on an exterior of the building structure, the cladding shingle comprising:

a fiber cement substrate further comprising:

a first edge and a second edge opposite the first edge, wherein the first edge is a top edge and the second edge is a bottom edge;

a substantially planar rear face extending between the first edge and the second edge; and a front face opposite the rear face and extending between the first edge and the second edge, the front face comprising:

an upper section spaced from the rear face by a first thickness, the upper section being substantially parallel to the rear face, the upper section extending directly from the first edge;

a lower section spaced from the rear face by a second thickness, the lower section being substantially parallel to the rear face, the lower section extending directly from the second edge;

a recessed portion having a first end adjacent the lower section and a second end opposite the first end, the first end spaced from the rear face by a first distance and the second end spaced from the rear face by a second distance, wherein the recessed portion is disposed at a first angle relative to the lower section such that the first distance is greater than the second distance; and a step contiguous with the upper section and the second end of the recessed portion, the step disposed at a second angle relative to the upper section, wherein the second angle of the step is greater than the first angle of the recessed portion.

8. A cladding shingle for a building structure, the cladding shingle configured to be installed with a plurality of additional cladding shingles on an exterior of the building structure, the cladding shingle comprising:

a fiber cement substrate further comprising:

a first edge and a second edge opposite the first edge, wherein the first edge is a top edge and the second edge is a bottom edge;

a substantially planar rear face extending continuously and uninterruptedly between the first edge and the second edge; and a front face opposite the rear face and extending between the first edge and the second edge, the front face comprising:

an upper section spaced from the rear face by a first thickness, the upper section being substantially parallel to the rear face, the upper section extending from the first edge;

a lower section spaced from the rear face by a second thickness, the lower section being substantially parallel to the rear face, the lower section extending from the second edge;

a recessed portion having a first end adjacent the lower section and a second end opposite the first end, the first end spaced from the rear face by a first distance and the second end spaced from the rear face by a second distance, wherein the recessed portion is disposed at a first angle relative to the lower section such that the first distance is greater than the second distance; and a step contiguous with the upper section and the second end of the recessed portion, the step disposed at a second angle relative to the upper section, wherein the second angle of the step is greater than the first angle of the recessed portion.

9. The cladding shingle of claim 8, wherein the step comprises a smaller portion of the front face than the recessed portion.

10. The cladding shingle of claim 8, wherein the first thickness of the upper section is equal to the second thickness of the lower section.

11. The cladding shingle of claim 8, wherein the first distance of the first end of the recessed portion is equal to the second thickness of the lower section.

12. The cladding shingle of claim 8, wherein the first angle of the recessed portion is between 0 degrees and 10 degrees.

13. The cladding shingle of claim 8, wherein the second angle of the step is between 30 degrees and 90 degrees.

14. The cladding shingle of claim 8, wherein the upper section extends from the first edge along a first portion of a height of the cladding shingle, and wherein the lower section extends from the second edge along a second portion of the height of the cladding shingle, the height extending between the first and second edges of the cladding shingle.

15. The cladding shingle of claim 8, wherein the front face has a wood grain texture pattern, the wood grain texture pattern covering at least the lower section and the recessed portion of the front face.

16. The cladding shingle of claim 15, wherein the wood grain texture pattern comprises circular saw marks.

17. The cladding shingle of claim 8, wherein the step, the recessed portion, and the lower section are positioned between the upper section and the second edge of the cladding shingle.

18. The cladding shingle of claim 17, wherein the recessed portion, the step, and the upper section are positioned between the lower section and the first edge of the cladding shingle.

* * * * *